US006827529B1

(12) United States Patent
Berge et al.

(10) Patent No.: US 6,827,529 B1
(45) Date of Patent: Dec. 7, 2004

(54) VACUUM PNEUMATIC SYSTEM FOR CONVEYANCE OF ICE

(75) Inventors: J. Eric Berge, Irvine, CA (US); Glenn S. Seamark, Lake Forest, CA (US); Alfred A. Schoeder, San Antonio, TX (US); Mark A. McClure, Chino Hills, CA (US); Daniel A. Glimn, Anaheim Hills, CA (US)

(73) Assignee: Lancer Ice Link, LLC, San Antonio, TX (US)

( * ) Notice: Subject to any disclaimer, the term of this patent is extended or adjusted under 35 U.S.C. 154(b) by 0 days.

(21) Appl. No.: 09/364,794

(22) Filed: Jul. 30, 1999

Related U.S. Application Data

(63) Continuation-in-part of application No. 09/207,075, filed on Dec. 7, 1998, now abandoned, which is a continuation-in-part of application No. 09/128,050, filed on Aug. 3, 1998, now abandoned.

(51) Int. Cl.[7] ..... B65G 53/66

(52) U.S. Cl. ..... 406/28; 406/120; 406/145; 406/151; 406/156; 406/181; 141/65; 141/82; 62/135; 62/344; 222/53; 222/56; 222/146.6

(58) Field of Search ..... 406/21, 28, 120, 406/145, 151, 156, 181, 182, 183; 141/65, 82, 67; 62/135, 340, 341, 344, 353, 378; 222/1, 146.6, 630, 527, 56, 53; 414/219, 220; 200/228, 230, 214

(56) References Cited

U.S. PATENT DOCUMENTS

| | | | |
|---|---|---|---|
| 1,818,367 | A | 8/1931 | Wallace |
| 2,586,144 | A | 2/1952 | Benoit |
| 2,793,914 | A | 5/1957 | Gardeniers et al. |

(List continued on next page.)

FOREIGN PATENT DOCUMENTS

| | | |
|---|---|---|
| DE | 1877476 | 8/1963 |
| DE | 1201247 | 9/1965 |

(List continued on next page.)

OTHER PUBLICATIONS

McCann's Engineering & Mfg. Co. (Los Angeles, CA), Brochure: "Ice Delivery System" 1F2—0500 (4 pages) dated Mar. 1999.

*Primary Examiner*—Donald P. Walsh
*Assistant Examiner*—Jeffrey A. Shapiro
(74) *Attorney, Agent, or Firm*—Gordon & Rees LLP

(57) ABSTRACT

Vacuum pneumatic conveying apparatus and method are described to provide for a simple, economical, convenient (and preferably automatic) system for conveying ice on an as-required basis from a source such as an ice maker to one or more receptors at locations remote from that source. The system can be configured such that dispensing locations can be added or eliminated from the system or temporarily taken "off line" from the system without the need to change the basic system configuration or the central ice providing apparatus. The apparatus in various embodiments includes an ice source, a conveying conduit from the source to the receptor, a vacuum pump for moving the ice through the conduit by vacuum, and the receptor to collect the conveyed ice. The receptor may be an ice/beverage dispenser, an accumulator for retention and discharge to further devices, an intermediate storage dispenser, or an air lock device from where the ice can be projected over significant distances. Ice and vacuum may simultaneously be routed into different branched routes, utilizing a unique diverter/air shifter with the capability of providing routing to up to four different routes. Appropriate sensors and controllers, which may be microprocessor-based, may be used to automate the system. The entire system is easily cleanable. The system is advantageously used by restaurants, groceries, hotels and motels, hospitals, laboratories, and many other establishments where the providing of ice at various locations is desirable or required.

40 Claims, 15 Drawing Sheets

U.S. PATENT DOCUMENTS 3,037,776 A 6/1962 Younce
3,410,530 A 11/1968 Gilman
3,527,252 A 9/1970 Cook et al.
3,580,416 A 5/1971 Hoenisch
3,638,392 A 2/1972 Welker, Jr., et al.
3,659,809 A * 5/1972 Cook ..... 243/19
3,771,560 A 11/1973 Conti et al.
3,798,923 A * 3/1974 Pink et al. ..... 62/266
3,799,622 A 3/1974 Hek
3,814,542 A 6/1974 Iglesias et al.
3,877,241 A * 4/1975 Wade ..... 62/137
3,921,980 A 11/1975 Artzer
3,945,683 A 3/1976 Wise
3,951,461 A 4/1976 De Feudis
4,008,865 A * 2/1977 White et al. ..... 243/6
4,036,346 A 7/1977 Livingston
4,104,889 A 8/1978 Hoenisch
4,124,145 A 11/1978 Spinner et al.
4,171,067 A 10/1979 Faulkner et al.
4,172,535 A 10/1979 Smith
4,185,806 A 1/1980 Dremann
4,189,063 A 2/1980 Matthiesen
4,194,362 A 3/1980 Nonnenmacher
4,287,725 A 9/1981 Hoenisch
4,288,074 A 9/1981 Kainz
4,301,880 A 11/1981 Krambrock et al.
4,346,824 A 8/1982 Miller et al.
4,379,663 A 4/1983 Allison
4,394,259 A 7/1983 Benny et al.
4,409,918 A * 10/1983 Wagner ..... 114/40
4,552,489 A * 11/1985 Jacobson et al. ..... 406/39
4,754,519 A 7/1988 Duran et al.
4,788,830 A 12/1988 Schreiner et al.
4,805,255 A 2/1989 Hed
4,825,758 A 5/1989 Snowball et al.
4,862,649 A * 9/1989 Davis et al. ..... 51/437
4,913,315 A 4/1990 Wagner
4,961,446 A * 10/1990 Berg et al. ..... 141/144
4,963,172 A * 10/1990 DeMarco ..... 55/429
4,964,575 A 10/1990 Takata
4,981,237 A 1/1991 Landers
4,990,169 A * 2/1991 Broadbent ..... 62/72
5,029,737 A 7/1991 Yamamoto
5,033,914 A * 7/1991 Wuertele et al. ..... 406/109
5,106,238 A 4/1992 Rehwinkel et al.
5,147,152 A 9/1992 Link
5,167,471 A 12/1992 Kice et al.
5,299,427 A 4/1994 Miller et al.
5,354,152 A 10/1994 Reinhardt et al.
5,383,493 A 1/1995 Brandauer et al.
5,408,924 A * 4/1995 Arendt et al. ..... 99/516
5,415,012 A * 5/1995 Maier-Laxhuber et al. ... 62/269
5,433,559 A * 7/1995 Vande Sande ..... 406/145
5,450,984 A 9/1995 Rohr
5,458,851 A 10/1995 Schroeder et al.
5,549,421 A 8/1996 Reinhardt et al.
5,622,457 A 4/1997 Thiele
5,636,710 A * 6/1997 Ables et al. ..... 186/41
5,660,506 A 8/1997 Berge et al.
5,758,992 A 6/1998 Sawallisch
5,789,893 A 8/1998 Watkins
5,882,149 A 3/1999 DeWitt et al.
5,911,884 A 6/1999 Boulter
5,931,003 A * 8/1999 Newman et al. ..... 62/74
5,993,117 A * 11/1999 Lancaster et al. ..... 406/3
6,044,954 A 4/2000 McLaughlin
6,068,160 A * 5/2000 Fancher ..... 222/41
6,093,312 A 7/2000 Boulter
6,266,945 B1 * 7/2001 Schroeder ..... 53/473
6,279,329 B1 * 8/2001 Berge et al. ..... 62/66
6,571,573 B1 6/2003 Henry

FOREIGN PATENT DOCUMENTS

DE 2510415 9/1976
DE OS 25 10 415 9/1976
EP 0466428 A2 1/1992
FR 2528017 9/1983
FR 2 752 048 2/1996
FR 2752048 2/1998
GB 2241696 A 9/1991
JP 56161224 11/1981
JP 56161224 A 12/1981
JP 57001124 A 1/1982
JP 57001124 6/1982
JP 59209991 11/1984
JP 04013072 1/1992
JP 06176266 6/1994
JP 08054165 2/1996

* cited by examiner

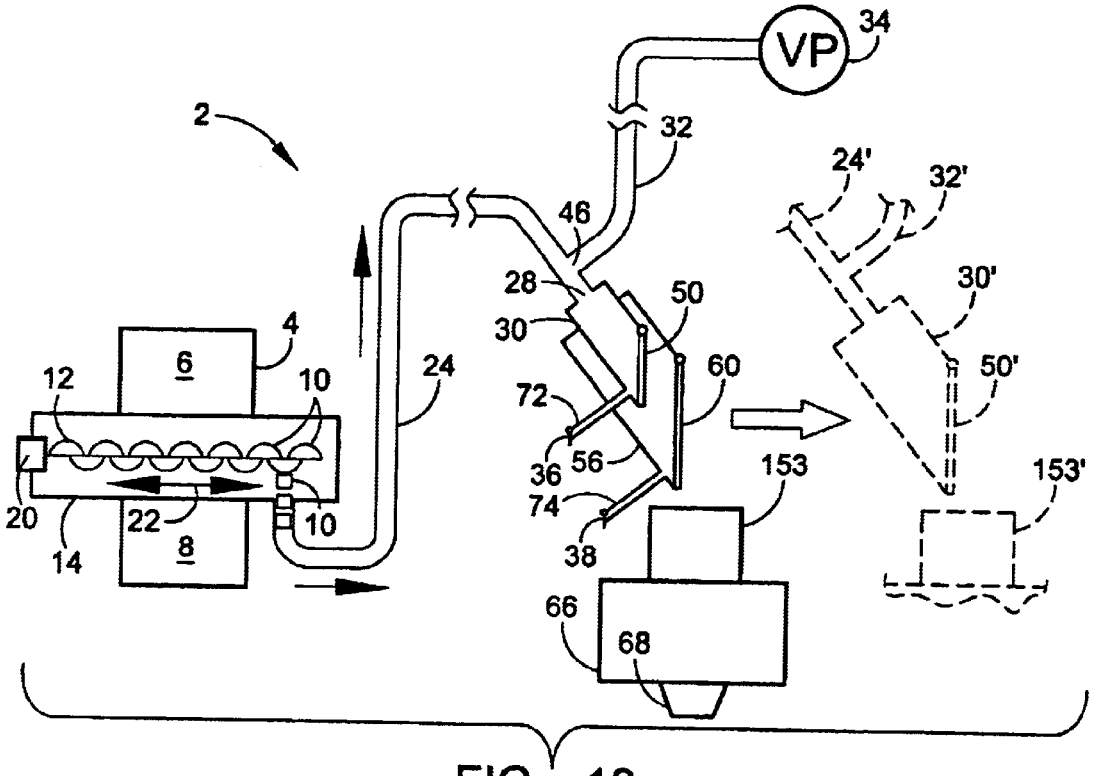
FIG. 13
FIG. 14
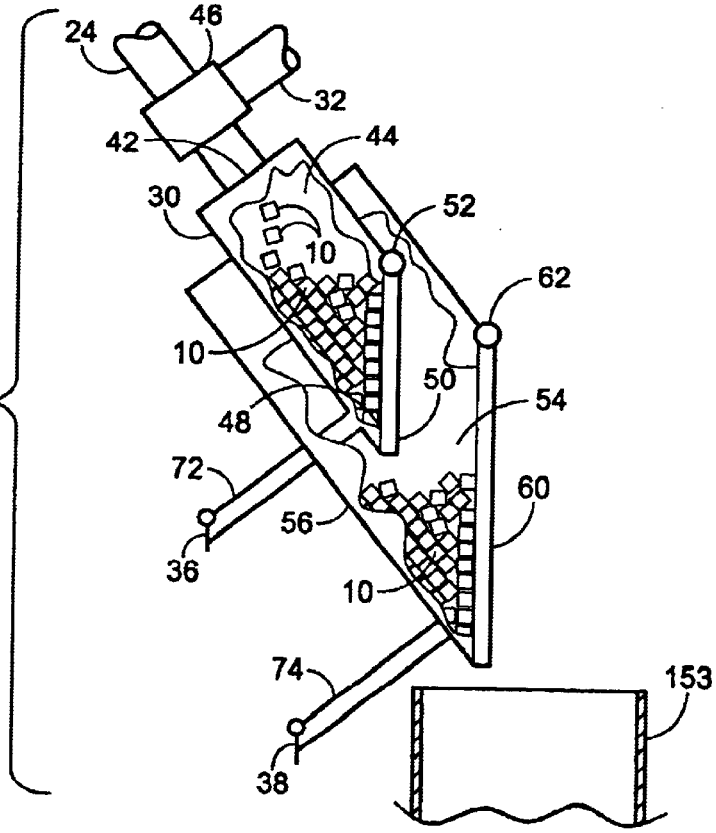

VACUUM PNEUMATIC SYSTEM FOR CONVEYANCE OF ICE

CROSS-REFERENCE TO RELATED APPLICATION

This application is a continuation-in-part of application Ser. No. 09/207,075, filed Dec. 7, 1998 now abandoned, which in turn is a continuation-in-part of application Ser. No. 09/128,050, filed Aug. 3, 1998 now abandoned, both of like title.

BACKGROUND OF THE INVENTION

1. Field of the Invention

The invention herein relates to pneumatic conveyor systems. More particularly it relates to a vacuum pneumatic conveyor system for the rapid and efficient conveyance of ice.

2. Description of the Prior Art

In many commercial establishments there are ice dispensers from which patrons, employees or both can collect ice pieces (such as ice cubes) for chilling beverages or for other purposes. Among the most common examples of such establishments are the "fast food" restaurants. In a typical fast food restaurant there will be a single large ice making machine in the kitchen area which manufactures large quantities of ice cubes. In the food serving area (behind the counter) and/or in the customer service area (in front of the counter) there will be at least one and usually several beverage and ice dispensing machines. Those behind the counter will be utilized by the serving staff to prepare iced beverages for window service to drive-up patrons or for counter service, while those in the customer service area will be used directly by the patrons. Commonly a patron will order and receive his or her food tray along with an empty beverage cup at the counter. The patron will then take the empty cup and food to a nearby beverage and ice dispenser, fill the cup with ice and a beverage, and then take the food and the chilled beverage to the dining area.

Such beverage and ice dispensing machines do not normally manufacture ice. Rather, each contains an internal bin which holds a limited quantity of ice cubes. The ice cubes can be dispensed from the bin by the patron's manipulation of a lever or other control which opens a dispensing chute and allows ice to fall into the patron's cup which is held below the discharge end of the chute. It will be readily appreciated that during busy times of the day, such as meal hours, a large number of patrons and/or service staff will be using such dispensing devices and the ice bins in the dispensers will frequently run out of ice. When this happens with a patron-area dispenser the patrons will be understandably annoyed. When it happens with a dispenser used by the serving staff, service to drive-up and counter patrons will be impeded and such patrons will become annoyed by having to wait for long periods of time to receive their beverages. To avoid this problem, such restaurants commonly assign an employee to monitor the ice and beverage dispensers and to keep the ice bins adequately full by periodically hand-carrying quantities of ice from the ice making machine in the kitchen to the dispensing machines. However, for many reasons such periodic manual refilling of the ice bins often does not get accomplished; the assigned employee may be busy at other tasks or may be forgetful, the restaurant may be especially crowded and busy, patrons may be dispensing ice in larger quantities or more rapidly than anticipated, and so forth. Whatever the cause, the failure of the restaurant to provide adequate quantities of ice upon patrons' demand is a constant and real source of customer dissatisfaction.

Other establishments also need effective ice manufacture and distribution. Many restaurants other than fast food restaurants have salad bars, seafood bars, smorgasbords, dessert bars and the like where food must be kept chilled on beds of ice. Since the ice beds are exposed to the restaurants' normal room temperatures, the ice rapidly melts and must be periodically replenished. Similarly, cafeterias routinely place plates of salads and desserts, containers of beverages, and similar foods on beds of ice to stay chilled until selection by patrons. Again the ice beds rapidly melt and must be replenished. The same is true of supermarkets, grocery stores, and meat and fish markets, where many fresh vegetables and especially meats and seafood are displayed on beds of ice to keep them chilled.

Outside the restaurant, grocery and food service fields, hotels and motels provide ice vending machines available to guests so that the guests can fill room ice buckets and have ice available for beverages in their own rooms. In the hotel/motel setting the vending device will be an actual ice maker, similar to the one used in a restaurant kitchen. However, since a number of such ice makers are needed to server guests throughout the facility, the overall cost is high. Therefore hotels and motels seek to minimize the number of such machines they have on the premises while yet providing a sufficient quantity of ice available to satisfy guests' demands. However, because the number of machines is kept to a minimum, many guests find that the location of the closest ice machine is inconvenient to their rooms. Conversely, those whose rooms are close to the ice making machines frequently complain about the traffic and noise associated with other guests coming to obtain ice.

Further, ice is commonly used in hospitals for a number of purposes, including providing chilled beverages to patients and staff and filling ice packs for patient treatment. As with hotels and motels, hospitals normally use ice making machines, but again because of the cost the number of such machines is kept to a minimum consistent with patient service and care. However, because of the minimum number of machines, frequently hospital staff find that they must walk long distances to obtain ice from the closest vending machine, extending the time away from their assigned posts.

Manual transport and replenishment of ice is often unsanitary and unsafe. Such introduces the real possibility of contamination of the ice, since the person handling the ice may be ill or dirty, or the ice, while open to the ambient atmosphere may come into contact with bacteria, dirt, or other contaminants. Ice frequently spills while being transported, and if not promptly cleaned up will melt, causing dangerously slippery floors. Also, manually moving ice can cause injury to the workers, such as back injuries from lifting heavy containers of ice or injuries from falling while attempting to dump the ice into the dispensers (which are normally elevated).

In the past there have been numerous systems for pneumatically conveying ice from an ice making machine to one or more ice dispensers using "positive pressure" air, i.e. air at a pressure above ambient. For instance, a convenient system which includes provision for storage of manufactured ice until needed for conveyance to the dispensers is described in U.S. Pat. No. 5,660,506 (Berge et al.). Numerous other systems are also known. Most of these systems operate at low positive pressure and high air flow volume. A few use higher pressure air at lower flow volume.

In the past vacuum systems have not been widely used as alternatives to high pressure air systems, especially in the conveyance of ice, and particularly over extended distances. A vacuum system for movement of fish from fishing boats to wharfside fish processes plants has been disclosed in U.S. Pat. No. 4,394,259 (Berry et al.). In the disclosed system, a wharf-mounted vacuum lift is used to draw fish out of the hold of a fishing boat and up to an elevated position, and then the fish drop by gravity to a belt conveyer system at the entrance to a wharfside processing plant. The total travel distance of the fish is short. Since the purpose of the system is to empty a boat's hold as quickly as possible, so that the boat can move away from the wharf, there is no provision for metering the movement of the fish, or for moving the fish only on demand, or for directing the fish into several different routing paths. Further, the system appears to be prone to frequent blockages, since no structure is shown which would prevent an excessive number of fish from being drawn into the inlet of the vacuum line simultaneously and becoming jammed together at the inlet, thus requiring the system to be shut down so that the blockage can be removed.

Prior art systems are usually "closed path" systems, which means that somewhere in the system there is a restriction or block which prevents devices such as cleaning equipment from being run completely through the system. A few prior art systems have been capable of using liquid cleaners, but most systems have required mechanical scouring involving equipment rather than chemicals, so that the systems must be at least partially dismantled to provide access to the interiors.

SUMMARY OF THE INVENTION

The apparatus and method described and claimed as the present invention provide for a simple, economical and convenient vacuum pneumatic system for conveying ice on an as-required basis from an ice supply source (e.g., an ice maker) to one or more locations remote from that source. The system can be configured to convey the ice automatically and on various schedules or on demand to the numerous dispensing or end use locations to maintain adequate quantities of ice on hand at such locations at all times. Hand carrying or trucking of quantities of ice to fill storage, processing or dispenser bins is eliminated. By use of unique ice accumulators in the system ahead of the dispensers, the system can be operated essentially continuously, even as quantities of ice are being discharged to the dispensers.

The invention is designed to convey ice pieces to selected remote locations and keep adequate supplies of ice on hand at those locations for dispensing to restaurant patrons and employees, hotel and motel guests, hospital staff and others similarly situated. The system can be arranged with a central ice making machine in a location readily available for service but where it does not interfere with establishment operations, patrons or employees, and the ice can be readily vacuum conveyed to dispensing machines which are conveniently located for use by establishment patrons and employees. Since dispensing devices are less costly than ice making devices, an optimum number of dispensing devices can be placed at various convenient locations. The system can also be configured such that additional dispensing locations can subsequently be added or under-utilized ones can be eliminated from the system without the need to change the basic system configuration or the central ice making apparatus.

Importantly, the system can also be configured with intermediate large storage ice receptacles, from which ice can be dispensed to numerous smaller, local end use dispensers. Such intermediate receptacles further aid in permitting the system to operate generally continually at uniform ice production rates, while still providing for adequate ice availability at the end user dispensers even during periods of high ice demand.

Further, noise-generating components such as an ice making machine and the vacuum pump can be placed in their own sound proofed enclosure or room. This isolates the noise of the components from working areas, patron areas, guest areas, patient areas, etc. It also allows the ice maker or vacuum pump to work efficiently and saves on energy costs, since the heat generated by these devices can be isolated and does not add to the cooling load in adjacent working, dining, living or patient areas.

Since the system operates by vacuum rather than positive pressure, and since the accumulation chambers release ice without velocity or air noise, the delivery of ice is accomplished in a much quieter manner than has been the case with prior systems.

The present system also has the capability of being readily cleanable, which is of course very important when ice is to be conveyed. The ice conveyance conduits of the present system may, if desired, be chilled conveying lines, which results in efficient transport of the frozen items with no significant thawing in transit.

Essentially the system in its basic form receives ice from an ice source, such as a commercial ice maker which makes ice cubes, and conveys that ice under vacuum through an ice conduit from the ice source to a receptor at the remote location. The receptor may be any device which holds, reconveys and/or dispenses ice. Typical receptors include ice dispensers, ice/beverage dispensers (IBDs), accumulators, air lock devices, bins, large scale storage facilities and the like; multiple receptors in series and/or parallel are common. The source of vacuum is normally a vacuum pump in fluid communication with the ice conduit through a vacuum line. "Vacuum" as used herein means "negative gas pressure," (i.e., gas pressure reduced below ambient pressure). The vacuum pump creates negative gas pressure within the conduit which causes the ice to be conveyed by "pulling" (rather than by "pushing" as positive pressure prior art systems have done) to the receptor.

Numerous variations and embodiments of the system are possible. These involve incorporation into the system of one or more diverters or diverter/shifters which permit the routing of ice and/or vacuum into and through multiple pathways to any of a plurality of receptors. Such diversions may include both increasing diversions, where additional paths are opened, and decreasing diversions, where multiple parts are combined.

The ice may be sent directly to receptors which themselves can dispense ice (and often also beverages) to end users, or may be sent to accumulators, which hold quantities of ice and then release them to other accumulators or ice dispensers, or may be sent to air lock devices, which permit the ice to be projected substantial distances, to permit filling of large or mobile containers.

The system may incorporate intermediate storage of ice, so that intermediate storage containers may be filled while end user ice demand is low and then be used to dispense the stored ice during high demand periods when the ice sources cannot produce new ice fast enough to keep up with the demand.

Therefore, in one apparatus embodiment, the invention involves apparatus for conveying ice in the form of a plurality of pieces each having physical characteristics amenable to transport by negative air pressure pneumatic conveyance, from a source of the ice to a remote location under the negative air pressure, which comprises a hollow elongated ice conduit connecting the source of ice and the remote location and providing ice communication therebetween; a receptor at the remote location for receiving the ice; and a vacuum pump in fluid communication through a vacuum line with the receptor for withdrawing air from the conduit and creating a vacuum comprising the negative air pressure in the conduit, the negative air pressure causing the ice to traverse the conduit from the source into the receptor.

In other apparatus embodiments, the invention involves the receptor being an ice dispensing device or ice/beverage dispensing device, single or double accumulator(s) each having therein an openable gate for release therefrom at the remote location of accumulated pieces of ice conveyed thereto from the source, or an air lock device which is connected to the ice conduit on an upstream side and which has an inlet for pressurized air from a source thereof on a downstream side and another conduit extending from the downstream side for passage of the pressurized air, such that ice entering the air lock device from the ice conduit passes through the air lock device and propelled through the another conduit at high velocity by the pressurized air.

In yet other apparatus embodiments, the invention involves sensors for detecting the presence or absence of ice in the receptor, and, when the presence of the ice is detected in the receptor, determining the quantity of ice so detected.

Partial or complete electronic control of the system is contemplated.

Sources of ice may include machinery for making pieces of ice, an ice unbridger, a container having the pieces of ice therein and from which the pieces of ice are motivated into to the ice conduit, another conduit in which the pieces of ice are being conveyed and which is in ice communication with the ice conduit or introducer means for introducing the pieces of ice essentially seriatim into the ice conduit.

In a process or method embodiment, the invention involves a process for conveying ice in the form of a plurality of pieces each having physical characteristics amenable to transport by negative air pressure pneumatic conveyance, from a source of the ice to a remote location under the negative air pressure, which comprises providing a hollow elongated ice conduit connecting the source of ice and the remote location and providing ice communication therebetween; a receptor at the remote location for receiving the ice; and a vacuum pump in fluid communication through a vacuum line with the receptor for withdrawing air from the conduit and creating a vacuum comprising the negative air pressure in the conduit, the negative air pressure causing the ice to traverse the conduit from the source into the receptor; withdrawing air from the receptor and conduit and creating a vacuum comprising the negative air pressure in the receptor and conduit; and causing the ice to traverse the conduit from the source into the receptor under the influence of the negative air pressure.

In another method or process embodiment, the invention involves connecting the vacuum line in fluid communication into the ice conduit at a first point of connection upstream of a second point of connection of the ice conduit into the receptor, and spaced apart from the second point of connection by an interval not greater than a distance that the ice pieces can traverse under momentum imparted to them by their prior conveyance through the conduit by the negative air pressure; and conveying the ice pieces under that amount of force of the negative air pressure at the first point of connection sufficient to cause the ice pieces to continue to traverse entirely through the first conduit and into the receptor without diversion of any ice pieces into the first vacuum line.

In yet another method or process embodiment, the invention involves introducing a liquid cleaner into the ice conduit, conveying the liquid cleaner through the conduit by the negative air pressure and contacting substantially all interior surfaces of the conduit for removal of contaminants therefrom, such that the interior surfaces are cleaned of the contaminants by passage of the liquid cleaner, and, optionally, also causing at least a portion of the liquid cleaner also to pass through and contact substantially all interior surfaces of at least one of the source of ice and the receptor, such that such that the interior surfaces are cleaned of the contaminants by passage of the liquid cleaner.

In other process and apparatus aspects the invention involves apparatus which operates to divert and return conveying air to the vacuum pump and permit ice to continue to travel by momentum into a receptor. The same aspect of the system can be used to remove some or all of water or other liquids from the system.

In other method or process embodiments, the invention conveying the ice through a plurality of serially connected conduits to reach a receptor, or simultaneously routing ice and vacuum through a plurality of serially connected paired ice conduits and vacuum lines to a receptor.

Also as a principal element in this invention is a unique type of diverter/air shifter, which permits diversion of both air and ice through 2–4 different routes.

These and other embodiments, aspects, applications and variations of the invention will be described below, with particular reference to the accompanying Figures of the drawings.

BRIEF DESCRIPTION OF THE DRAWINGS

FIGS. 13–17 are schematic diagrams of various exemplary embodiments of the system of this invention, in which are shown various individual optional components and operating modes.

DETAILED DESCRIPTION AND PREFERRED EMBODIMENTS

For brevity herein, the "pieces" of ice which are conveyed will frequently be exemplified and referred to simply as "ice cubes." It will be understood, however, that the term "ice cubes" is not to be restricted solely to ice pieces of essentially cubical shape, but will include ice pieces which have other substantially regular shapes such as half moons, crescents, cylinders, disks and various solid polygons. It is also intended to include pieces with irregular shapes, such as those formed by crushing, fragmenting, chipping or otherwise comminuting large solid blocks of ice into such irregular shapes. Ice which may be conveyed by this systems includes those ice products commonly known as "cube ice" (the above mentioned "ice cubes:), "nugget ice," "bridged ice," "granular ice," "chunk ice" and "crushed ice," or any other form or size of vacuum pneumatically conveyable ice pieces, regardless of the name applied.

Further for brevity, the conveying gas will be exemplified by air, which will be most commonly used. It is contemplated, however, that other gases which are inert to ice, the environment and to the materials from which the system 2 is constructed may also be used. Examples include carbon dioxide, nitrogen and argon. Other gases, such as the remaining Group VIII gases (other than radon), are possible, but are scarce and very expensive. Most other gases, such as most nitrogen oxides, halides, hydrocarbons and halocarbons, are or may be reactive with ice, corrosive to the system materials, hazardous to the environment, or otherwise detrimental, and are therefore not contemplated for use. Air is most preferred, followed by nitrogen and argon, since all are readily available, inert to ice and the system materials, inexpensive and can of course be vented safely to the ambient atmosphere.

Figure 1:
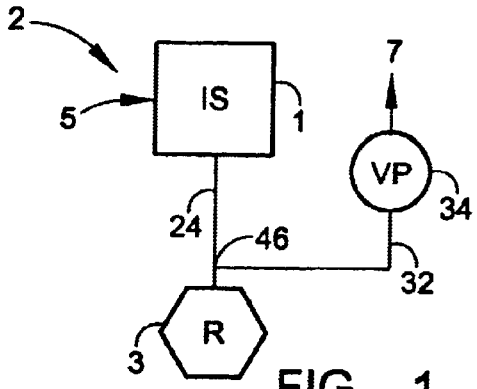
FIG. 1 is a schematic diagram illustrating the major components of the system and the vacuum-driven movement of ice cubes, through the system from the ice source to an ice receptor.
Figure 2:
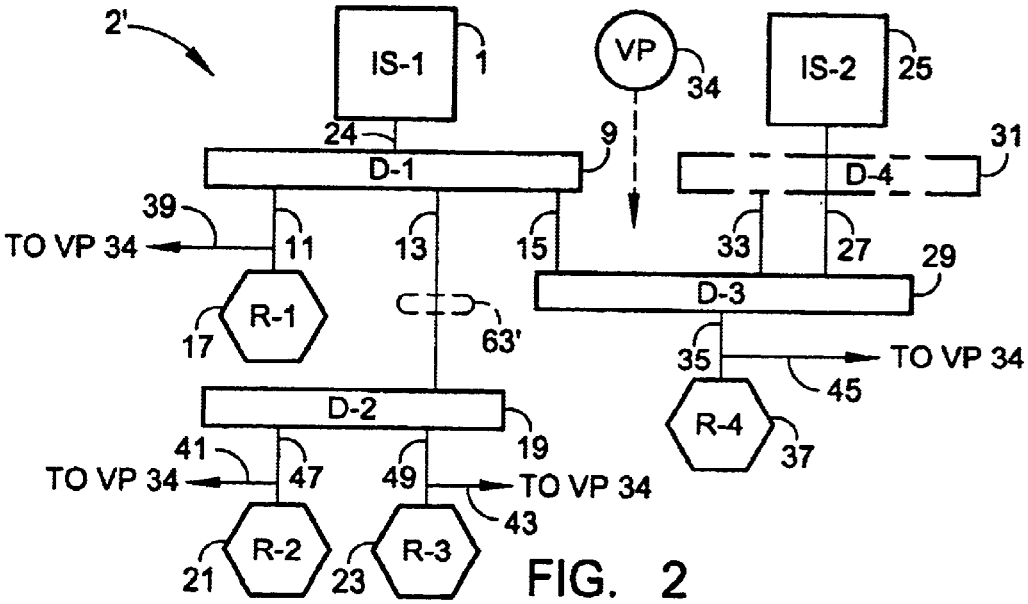
FIGS. 2 and 3 are schematic diagrams of an exemplary typical system of the present invention, including single and multiple diversion of ice, parallel diversion of ice and shifting of vacuum air flow, use of multiple ice sources, and increasing and decreasing diverters.
Figure 3:
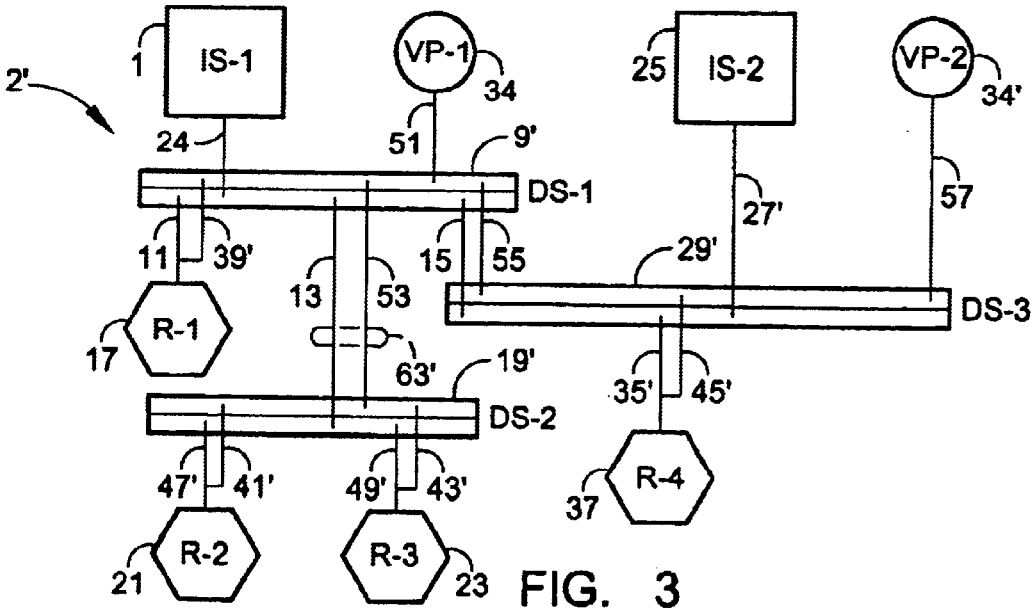

The invention will be best understood by reference to the drawings. Reference is first made to FIGS. 1, 2 and 3, which illustrate graphically the basic system 2 as well as two principal embodiments which include additional variations. The basic system 2 as shown in FIG. 1 includes ice source (IS) 1 which inserts the ice pieces (not shown here) into ice conduit 24 which provides ice communication with receptor 3. Connecting to conduit 24 immediately upstream the conduit's connection with receptor 3 is vacuum line 32, which provides fluid communication between conduit 24 and vacuum pump (VP) 34. Operation of vacuum pump 34 creates a negative air pressure throughout the vacuum line 32 and conduit 24, which draws air in, usually at the ice source 1, as indicated by 5. The air moving under the negative air pressure entrains the ice cubes and pulls them through the conduit 24. The connection of vacuum line 32 and conduit 34 at 46 is configured (as will be described below) such that the air flow is largely routed into the vacuum line 32 while the momentum of the moving ice cubes cause them to continue on in conduit 24 into the receptor 3. The moving air is vented by discharge from the vacuum pump 34 at 7.

Several typical, more complex, embodiments are illustrated by FIGS. 2 and 3. FIG. 2 shows a system 2' which a main ice source 1 (IS-1) which puts ice cubes (not shown here) into ice conduit 24. Conduit 24 leads to diverter 9 (D-1) and allows routing of ice to three alternative branch conduits 11, 13 and 15. Branch conduit 11 simply routes ice on to receptor 17 (R-1). Conduit 13 routes ice to a second diverter 19 (D-2) which in turn allows ice to be routed alternatively through conduits 47 and 49 to receptors 21 (R-2) or 23 (R-3). Diverters 9 and 19 can be considered to be "increasing" diverters, since they increase the number of available paths for the ice passing through them. The paths shown are of course exemplary, and it can be seen that any desired combinations of diverters, branch conduits and receptors can be used, subject only to the ability to create sufficient vacuum in each conduit. Also illustrated in FIG. 2 is the presence of a second ice source 25 (IS-2) which puts ice into ice conduit 27 which is shown as connecting directly to a third diverter 29 (D-3). Alternatively conduit 27 could itself lead to intermediate diverters such as 31 (D-4) and branch conduits such as 33 before reaching diverter 29. Conduit 15 from diverter 9, conveying ice from ice source 1, is also connected to diverter 29. The discharge conduit 35 from diverter 29 conveys ice to a fourth receptor 37 (R-4). Diverter 29 can therefore be considered to be a "decreasing" diverter, since it decreases the number of paths available to the ice passing through it. Diverter 29 also illustrates the ability of the present system to deliver ice from more than one source to specific receptor. This can be important in ice conveyance systems where large qualitites of ice are needed at a receptor, i.e., more ice than one ice source can be expected to provide, or where ice must be continually available, so that one or more back up ice sources must be available in the event of failure of a principal ice source.

FIG. 2 illustrates an ice routing system, with ice diverters and receptors. This particular type of embodiment does not include diversion or shifting of vacuum routing through the system. Rather each individual receptor has its own direct vacuum line connection to the vacuum pump 34 (or to some other vacuum source), as indicated respectively at 39, 41, 43 and 45.

FIG. 3 repeats the illustrative system 2' of FIG. 2, but shows that system modified to also route vacuum simultaneously with routing ice, by use of paired branch ice conduits and vacuum lines and diverter/shifters in place of simple diverters. Each of the diverter/shifters 9' (DS-1), 19' (DS-2) and 29 (DS-3) is shown schematically as having two parts, the ice diverter (upper half of the block) and vacuum shifter (lower half of the block). It will be seen that each conduit from an ice source 1 (IS-1) or 25 (IS-2) leads through the diverter portion of each diverter/shifter and on directly or indirectly to the respective receptors as described above for FIG. 2. In parallel, however, are branch vacuum lines which provide air communication with vacuum pumps 34 (VP-1) or 34' (VP-2). (Primed numerals indicate lines duplicated from FIG. 2; additional vacuum lines are designated 51, 53, 55 and 57.)

It will thus be seen that the ice vacuum conveyancing system of the present invention is highly versatile and can be configured in any number of different embodiments to accommodate any ice conveyancing requirements, from supplying a single receptor, such as a single ice dispenser or ice/beverage dispenser (IBD) in a small fast food restaurant or convenience store, to a large network of receptors distributed through a large building (such as a hotel, motel or hospital) or across a cluster or campus of buildings (such as a resort or medical complex).

Figure 4:
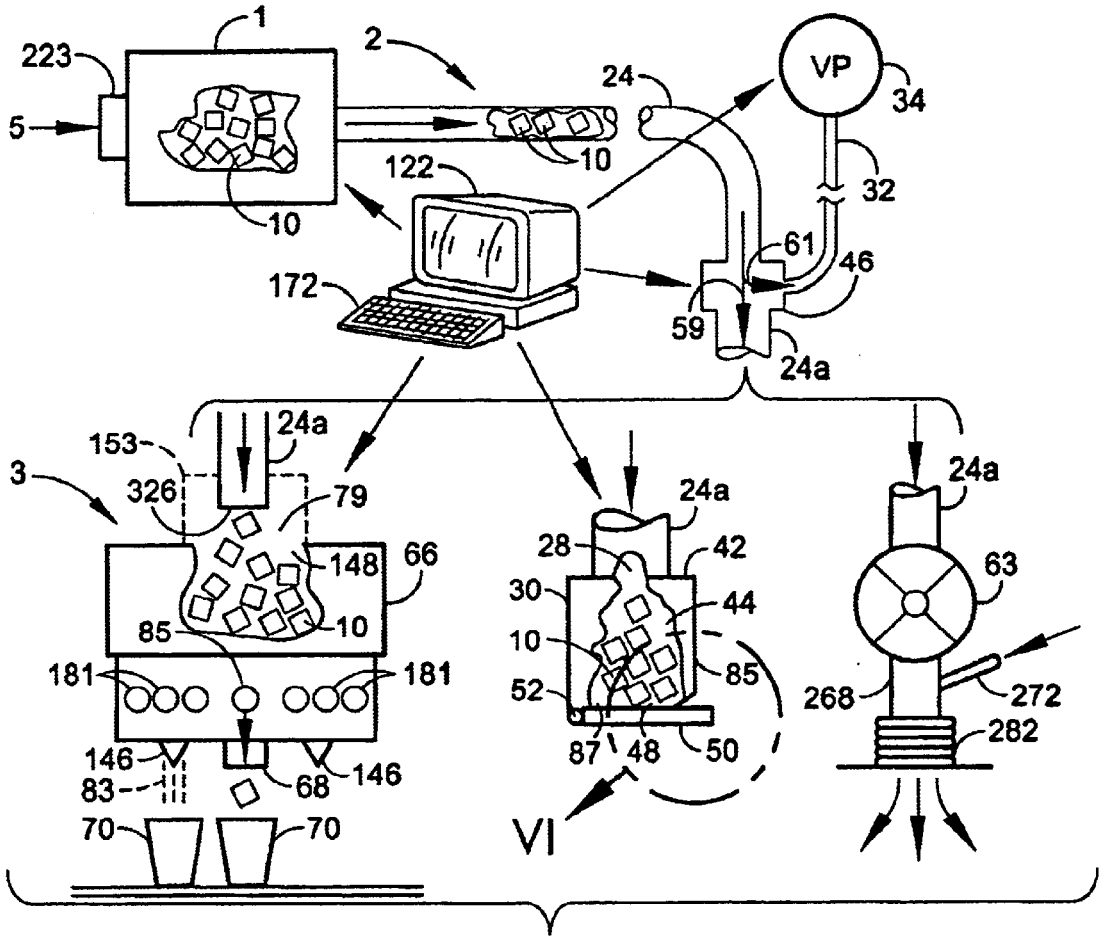
FIG. 4 is a pictorial diagram illustrating the various components of the system, computer control of all or parts of the system, and typical types of ice receptors.

FIG. 4 illustrates the basic system 2 in more detail. The ice source 1, which may be an ice maker such as 6 (see FIG. 13), a supply bin or container in which a large supply of ice is stored, an intermediate ("buffer") receptor, an entry port to which ice is delivered from another location, or any equivalent device, passes or discharges ice cubes 10 into conduit 24. Conduit 24 is as described connected in air communication with vacuum line 32 and vacuum pump 34 at diversion coupling 46. As the ice cubes 10 pass into coupling 46 their momentum carries them on into receptor 3, as indicated by arrow 59, while air is drawn out of coupling 46 into vacuum line 32 as indicated by arrow 61.

Receptor 3 is illustrated by three principal types of devices, each of which will be discussed in more detail below. The first receptor 3 is illustrated as an ice dispenser 66, or ice and beverage dispenser (IBD) 66. The second receptor 3 is illustrated as an ice accumulator 30, which holds the ice cubes 10 and then ejects them either automatically or upon some signal or manual action. The third receptor 3 is illustrated as an air lock device 63. Such an air lock device 85 may be used for several different functions. It may be used to project ice cubes over substantial distances, such as throughout a large ice storage container, bin or room. It may also be used at intermediate points in the conduits, as indicated at 63' in FIGS. 2 and 3, to allow incorporation of ice into the system at points other than regular ice sources such as 1 and 25. It may also be incorporated into other receptors, such as ice bins, to allow ice to be added to or removed from such receptors manually.

FIG. 4 also illustrates schematically that operation of the entire system 2, or selected parts of it, can readily be controlled by a electronic controller 122, such as a microprocessor and associated electronic circuitry or a computer using conventional or custom designed computer software. The electronic controller 122 is connected by appropriate circuitry to conventional sensors, pump controls, and the like. Further illustrations will be described below in conjunction with FIGS. 16 and 17. Since such electronic control equipment and circuitry are well known and may be readily selected and configured by those skilled in the art for each embodiment of the invention, they do not need to be further described in detail here.

Air entering the system at 5 may be filtered by filter 223 if desired, to eliminate air-borne contaminants. This can be particularly important when the system is used in restaurants where grease, oils and other materials from cooking are always present in the air. Filer 223 will be replaceable and/or cleanable to insure good air filtration and to minimize air pressure loss across the filter.

Figure 5A:
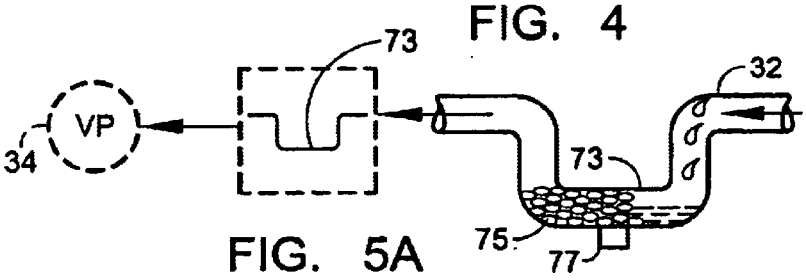
FIG. 5A is a side elevation view, partially in section, illustrating a means to trap moisture which may be drawn into the vacuum line from the separator.
Figure 5:
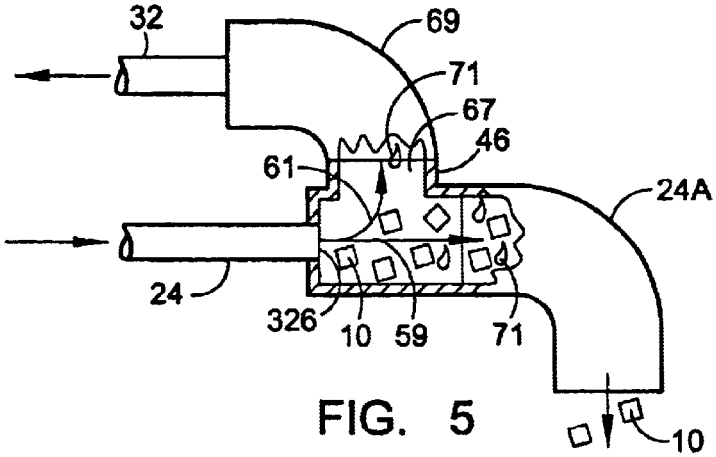
FIG. 5 is a side elevation view, partially in section, illustrating the operation of the diversion separator.

The operation of the diversion separator 46 is illustrated in FIG. 5. Ice traveling in conduit 24 exits from conduit 24 through outlet 326 into separator 46. Separator 46 is a chamber which has a significantly greater diameter than conduit 24. Because of the greater diameter of separator 46, the flow rate of the air moving under vacuum in conduit 24 drops off substantially as the air enters separator 46. This reduces the momentum of the air and allows it to be drawn into vacuum line 32 through opening 67 as indicated by arrow 61. The entrained ice cubes 10, however, do not lose much momentum upon entry into separator 46, and therefore are carried on through separator 46 into the extension 24*a* of conduit 24, as indicated by arrow 59, and then on to a receptor 3. It is possible that there may be some entrained water 71 in the air stream, such as from ice which may have melted, or water which was in the ice source 1 and was injected into conduit 24 along with the ice cubes 10. Normally most, if not all, of this water 71 will also have sufficient momentum to travel directly through separator 46 and into conduit extension 24*a* with the ice cubes 10. However, some portion of the water 71 (usually no more than a small portion) may be drawn into line 32 through opening 67. Since water must not be allowed to be drawn into vacuum pump 34, one or more moisture traps 73 will be incorporated into line 32, as shown in FIG. 5A. Each moisture trap may also contain a solid, granular adsorbent 75 for moisture if desired. It may be useful to have at least two traps 73 in line 32, so that the second trap can serve to stop any moisture which passes the first trap, and can also serve to verify that no moisture passes the first trap. To aid in inspection of the system, it is preferred that the moisture traps 73 be made of a transparent material or at least have a transparent window set into the trap wall, so that the presence or absence of moisture in each trap, and the volume of moisture when present, can be visually ascertained. Each trap may also have an openable drain 77 to allow excess moisture to be drained from the trap and allow replacement of depleted adsorbent 75.

A simple embodiment of the system 2 involves direct discharge of ice cubes 10 into an ice dispenser or IBD 66, as illustrated in FIG. 4. This can be accomplished merely by aligning the discharge end 326 of conduit extension 24*a* vertically over the opening 79 leading into the interior ice containment bin 148 within IBD 66. The ice 10 then falls freely into bin 148 as it exits the conduit extension 24*a*. If desired, an elongated receiver 153 may be placed around the discharge end of conduit extension 24*a* and opening 73 to insure that all ice cubes 10 fall into the bin 148. In the typical IBD, there are dispensing valves 146 to dispense beverages, which are supplied to the IBD 66 from remote beverage sources such as tanks, figals or bags-in-boxes through conduit 152. Typically several different beverages including soft drinks, water and fruit juices are available and the user selected the desired one by pressing one of the buttons 181 which opens a respective dispensing valve 146 in an appropriate one of the conduits to dispense the selected beverage into a cup or similar container 70 as shown at 83. The IBD also contains a discharge chute 68 to allow dispensing of ice 10 from bin 148 into a beverage container 70 or into any other convenient container, such as a hotel ice bucket 70' (FIG. 33), on demand, such as by the user pressing button 85, which opens a gate or other closure (not shown) in the bottom of bin 148 for a period of time sufficient to dispense the desired amount of ice 10 into the user's container 70.

Commercial ice/beverage dispensers which can be adapted for use in the present invention are available from Lancer Corporation. In ice distribution systems which are in parallel with beverage distribution and replenishment systems such as in fast food restaurants or bars, it may be desirable to group beverage and ice supply conduits into a single bundle running from the ice and beverage supply sources in the restaurant's kitchen area to each of the beverage/ice dispensers 66 behind or in front of the service counter. Beverage and ice conduits and vacuum lines can be sized such that all will fit within a 6 in (15 cm) insulated duct.

It is anticipated that the most common embodiment of the invention will be one in which a single or double accumulator is or is part of the receptor 3. Several systems using accumulators 30 (or 30 and 56) are illustrated in the Figures. An accumulator 30 is a hollow container with one end 42 attached to the discharge end of conduit extension 24*a* with an opening 28 providing ice communication between the two. The interior chamber 44 formed by wall 85 and end 42 is open at the opposite end 87. End 87 is openably closed by gate 50, which is hinged at 52. The accumulator 30 is preferably cylindrical in shape with a circular radial cross section, but may have a square, rectangular or polygonal cross section if desired. Similarly, the gate 50 may have the same shape, or may be differently shaped, or may be subdivided into two or more segments, as long as it serves to retain the ice within the accumulator and release it in response to the pneumatic, electrical, mechanical or manual operating means. The interior chamber 44 will have sufficient volume to contain a number of ice cubes 10; the exact amount will vary according to the demands of ice supply to be handled by each individual accumulator. The accumulator 30 may also if desired have a water drain 72 to drain any significant amount of water. The liquid drain line 72 may have an end gate 36 which, like gate 50, is held closed when there is vacuum in the accumulator 30. When the vacuum is broken by opening of gate 50, drain gate 36 opens of its own weight to allow accumulated water from chamber 44 to flow out through drain 72 to a liquid discharge (not shown). Since in most operations of the present system 2 the ice does not undergo significant melting, most entrained water is drawn off into vacuum line 32 and ice quantities spend only a relatively short time in any accumulator, drain 36 is often not needed.

Figure 35:
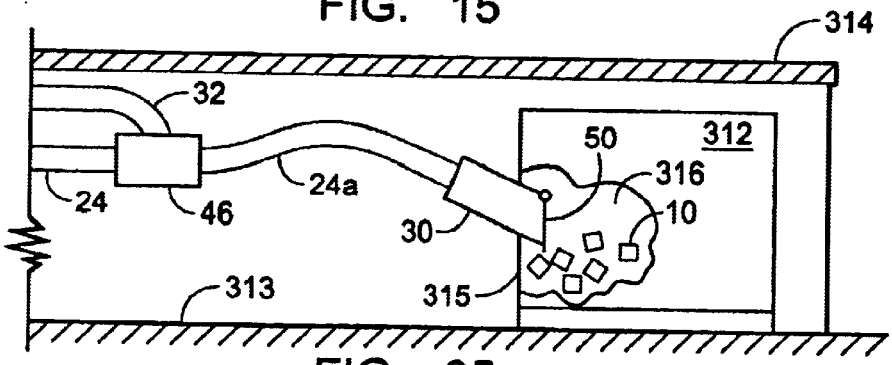
FIG. 35 is a side elevation view, partially in section, of a terminal portion of the system configured for installation in a low clearance location.

The orientation of the accumulator 30 may be vertical, horizontal or any angle in between, as illustrated variously in the Figures, with the orientation of the gate 50 hinged to accumulator 30 being such as to cover the open end 87 of the accumulator 30 and therefore dependent upon the configuration of the end 87. Gate 50 will preferably open such that ice can be discharged downward, as shown for example in FIGS. 4 and 7B. In other circumstances, the gate 50 will preferably open such that ice can be discharged in some other direction, as shown in FIG. 35.

Figure 7A:
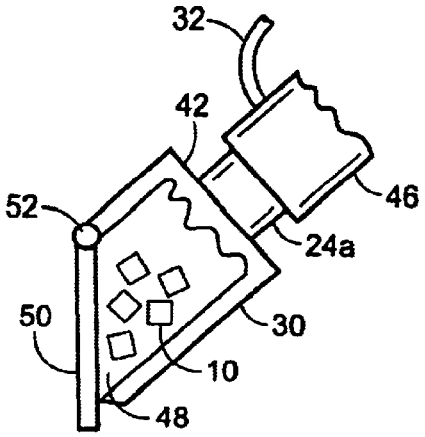
FIGS. 7A–12B are paired side elevation views of an accumulator as operated by different means, with the A view showing the accumulator gate closed and the B view showing the accumulator gate open.
Figure 7B:
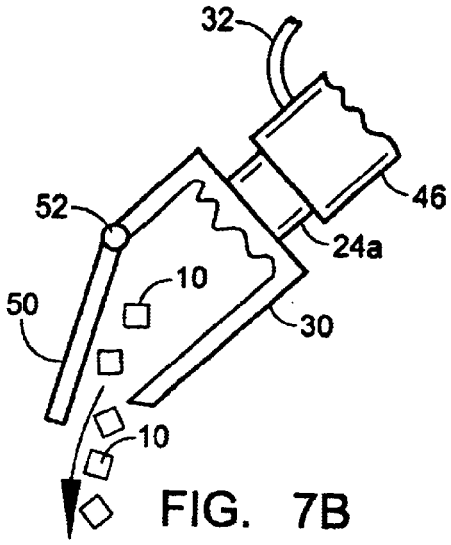
Figure 8A:
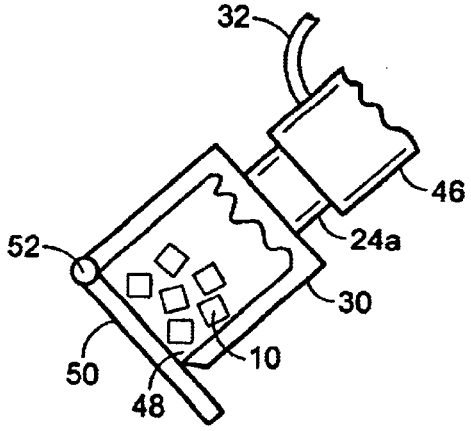
Figure 8B:
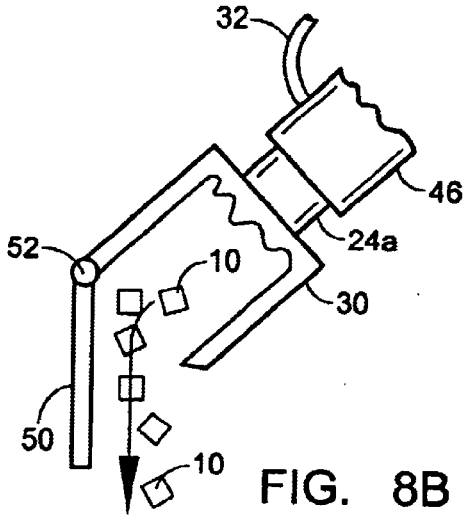

The operation of the gate 50 may be by pneumatic, electrical, mechanical or manual means. Each of FIGS. 7A–12B illustrates a typical operation under one of these means. Considering first FIGS. 7A–7B and 8A–8B, illustrating a pneumatic means for operation of the accumulator 30, as the cubes 10 exit from the conduit extension 24*a* and fall into chamber 44, they accumulate at the lower end 48 of accumulator 44 and at least some them come into contact with gate 50. Gate 50 is hinged at 52 and is normally held firmly closed by the vacuum created by vacuum pump 34 and seals the open end 48 of accumulator 30. As the cubes 10 accumulate in chamber 44 and press against gate 50, the increasing weight of the accumulating cubes exerts a "weight pressure" against the inner side of gate 50, which eventually becomes sufficient to force gate 50 open against the sealing pressure created by the vacuum which is biasing gate 50 into the closed position, as shown in FIGS. 7B and 8B. This causes relief of the vacuum during the period when gate 50 remains open. The opening of gate 50 causes most or all of the accumulated cubes 10 to fall by gravity out of accumulator 30 for collection as will be described below. The removal of that portion of the weight pressure of the cubes allows the vacuum to be re-established in accumulator 30 and the gate 50 is promptly drawn back to its closed and sealed position. The re-establishment of the vacuum again causes the air to be drawn through conduit 24, pulling additional cubes 10 toward the accumulator 30. Since the above sequence of events can occur very quickly, the opening and re-closing of gate 50 can allows the system to convey ice substantially continually when the invention is in use, since the vacuum can interrupted only for very short periods of time.

Figure 15:
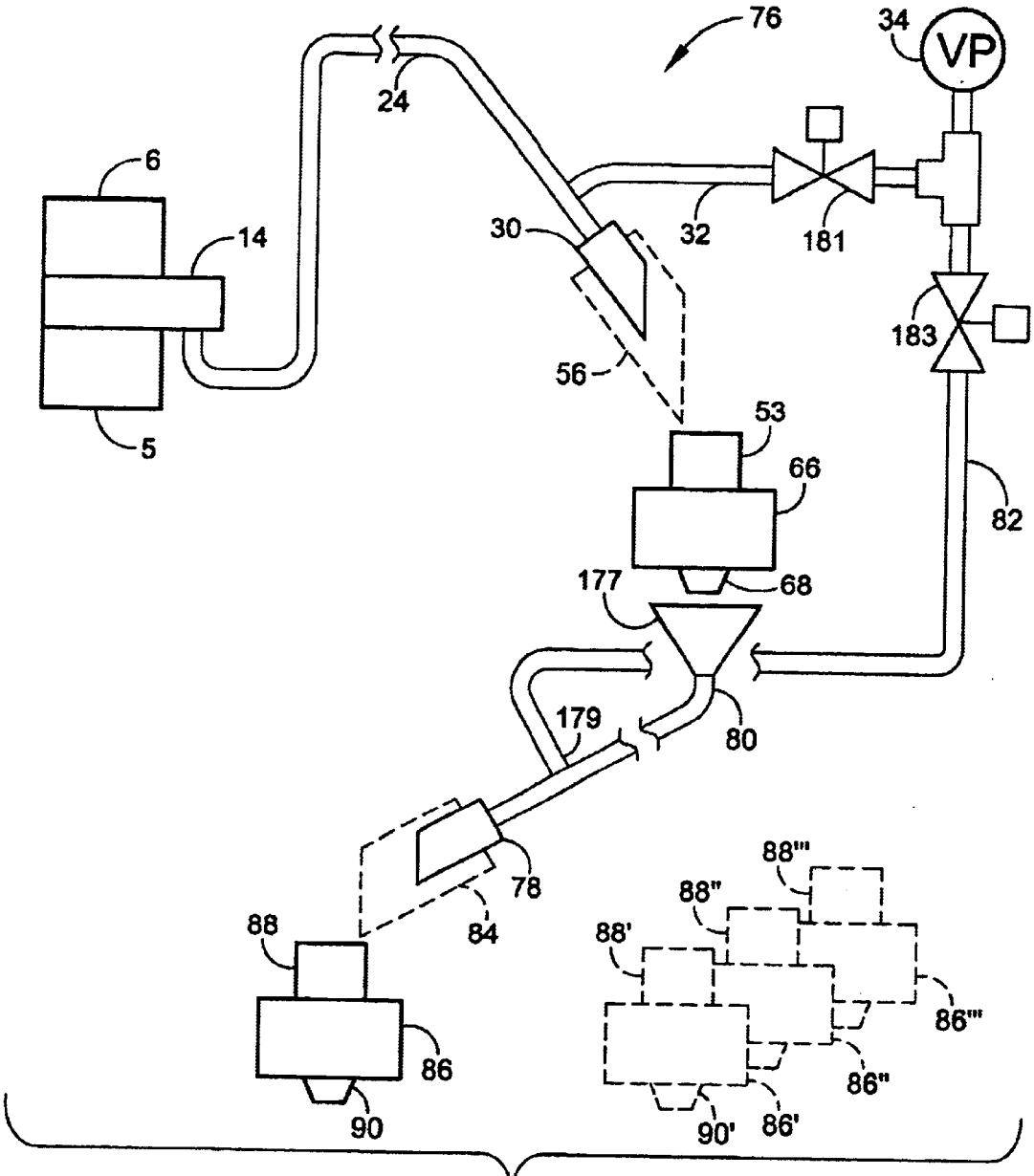
Figure 16:
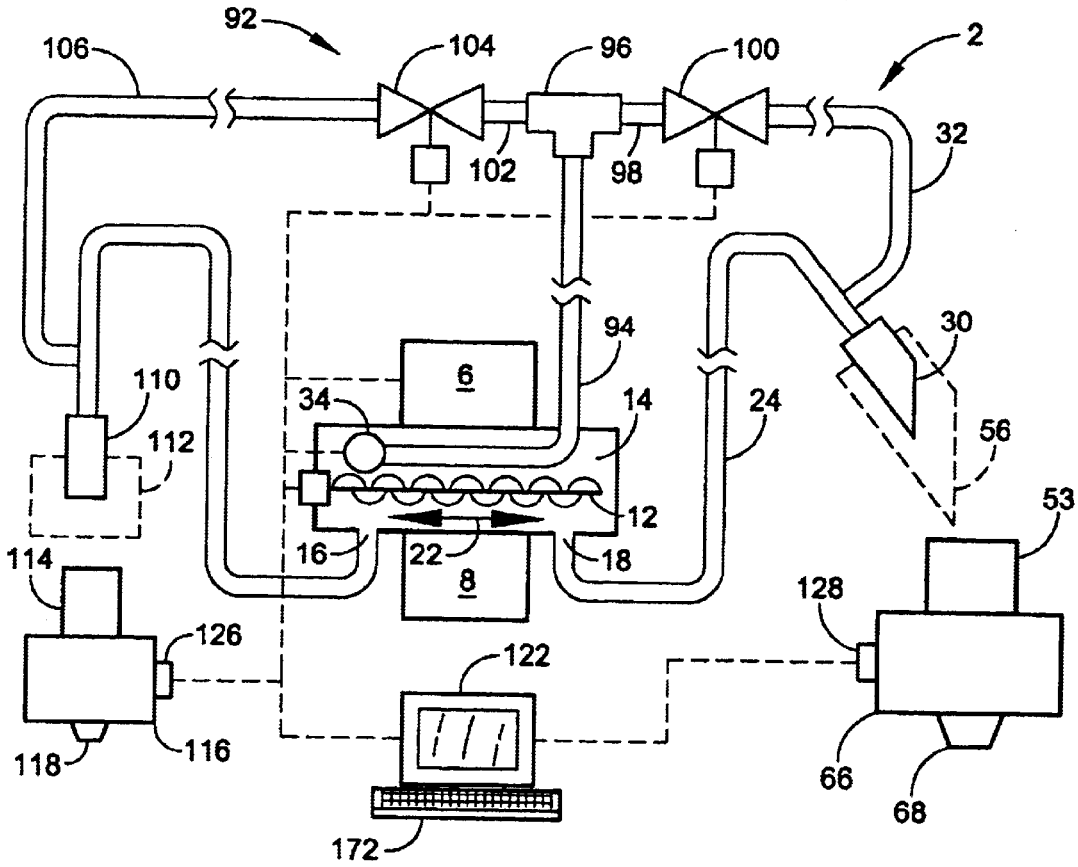

As an important alternative to opening of gate 50 by the biasing force of the weight of the accumulated ice 10, one can also cause gate 50 to open by relieving the vacuum in the accumulator 30 by external means. For instance, the vacuum pump 34 can be shut off, or, as illustrated in FIG. 15 or 16, the valve 181 or 100 between the accumulator 30 and the vacuum pump 34 can be closed, so that air pressure rises in that portion of the system from ice source 1 through conduit 24 to accumulator 30 due to influx of ambient air through ice source 1. The gate 50 is preferably hinged in a manner that upon relief of the vacuum, it opens of its own weight, such as is shown in FIGS. 8A–8B. Relief of vacuum in all or part of the system will also cause similar opening of other gates and valves which are similarly hinged, and which are biased closed only by the presence of the vacuum.

Figure 9A:
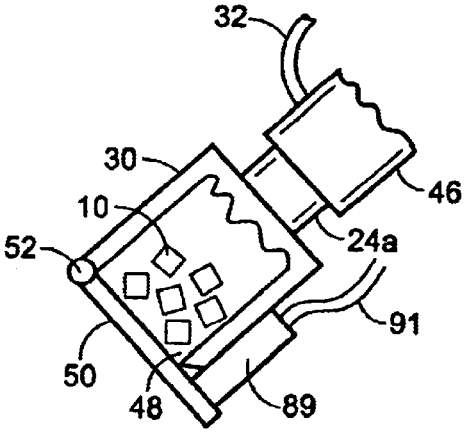
Figure 9B:
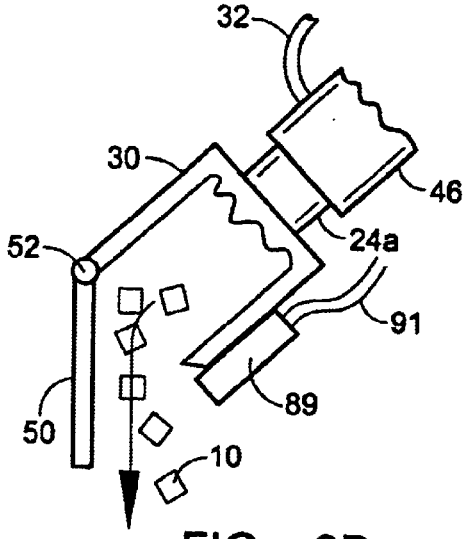

Electrical means of operating gate 50 are shown in FIGS. 9A–9B and 10A–10B. In FIG. 9A an electromagnet 89 powered through wires 91, when energized, holds gate 50 closed. Of course in this embodiment the gate 50 must be made of a metal which is attracted to the magnet. Upon de-energizing the magnet by cutting the power in wires 91, the gate 50 is released to fall open, preferably of its own weight as in FIG. 9B or by weight of the accumulated ice, in a manner analogous to that shown in FIG. 7B, discharging the ice. After discharge of the ice 10, the gate 50 will stay open until the electromagnet 89 is again energized. It may be desirable to spring load hinge 52 with a light torsion spring, similar to but weaker than that shown in FIGS. 11A–11B, to bias the gate 50 back toward the electromagnet 89 to assist the electromagnet 89 in again closing the gate 50.

Figure 10A:
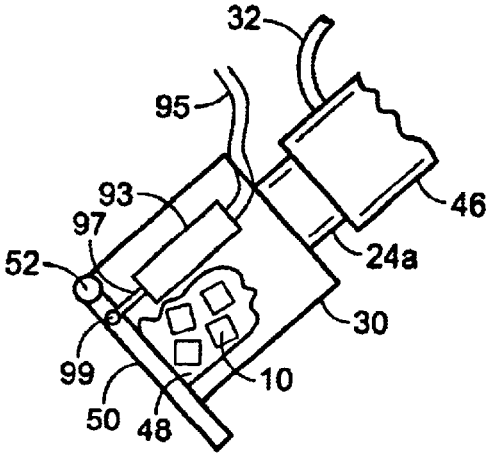
Figure 10B:
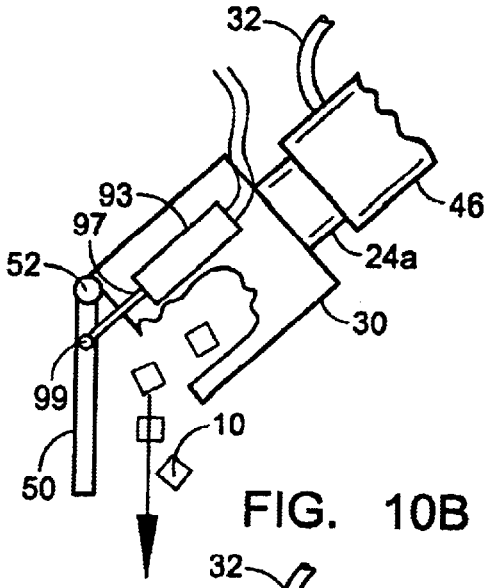

Another electrical means for operating gate 50 is shown in FIGS. 10A–10B, in which solenoid 93 powered through wires 95 is used to open and close the gate 50. When solenoid 93 is energized, it draws in rod 97, which is rotatably connected to gate 50 at 99, which pulls gate 50 closed. When the solenoid 93 is de-energized, rod 97 is released and the gate 50 swings open of its own weight as shown in FIG. 10B or by weight of the accumulated ice, again in a manner analogous to FIG. 8B, causing rod 97 to extend. Upon re-energizing of solenoid 93, rod 97 is retracted into the solenoid and pulls gate 50 closed again.

Figure 11A:
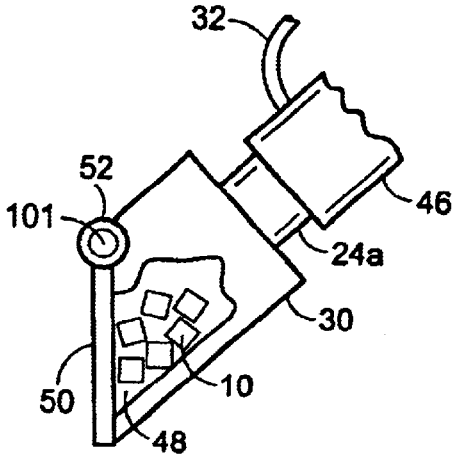
Figure 11B:
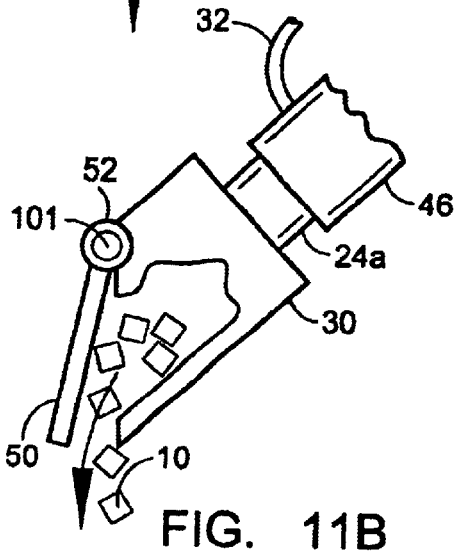

FIGS. 11A–11B illustrate a mechanical means for operating gate 50. In this embodiment hinge 52 is spring loaded by torsion spring 101. Spring 101 biases gate 50 closed and sustains that bias until the biasing force is exceeded by the weight of the accumulated ice 10 in the chamber 44, upon which the gate 50 is biased open and the ice 10 is discharged. Following ice discharge, spring 101 again biases the gate 50 closed.

Figure 12A:
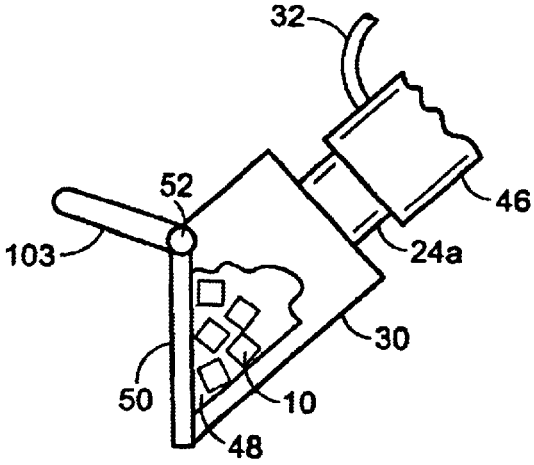
Figure 12B:
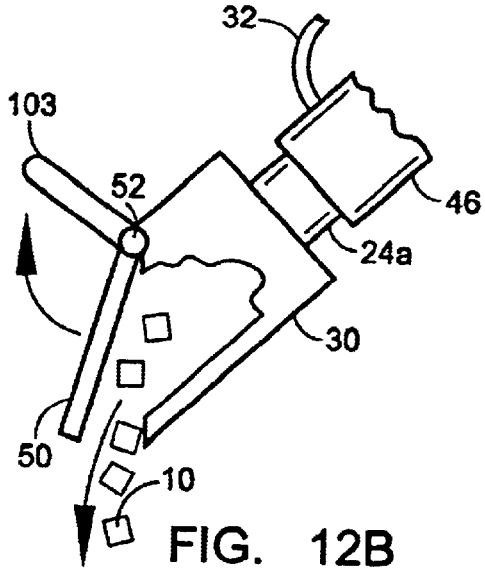

FIGS. 12A–12B illustrate a means of manual operation of gate 50. A lever 103 is attached to gate 50 at hinge 52. The resistance in hinge 50 will be great enough so that when lever 103 is positioned closed manually as shown in FIG. 12A, it will remain closed until the resistance force is exceeded by the weight of the accumulated ice 10 in the chamber 44, upon which the gate 50 is biased open, the ice 10 is discharged, and the lever is moved to position 103'. The operator must then manually move the lever back to position 103 to close the gate 50. If desired, hinge 52 may also be lightly spring loaded to assist is reclosing the gate 50 and to add a biasing force to the resistance of hinge 52.

Figure 6:
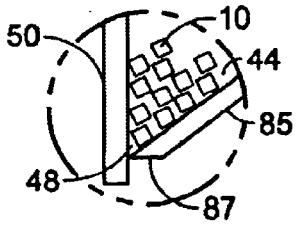
FIG. 6 is an enlarged detail view of the beveled or chamfered edge of an accumulator shown within the circle VI of FIG. 4.

It is preferred that at least the portion of the edge of end 87 be beveled or chamfered as shown in FIG. 6 or rounded as shown in FIGS. 11A and 11B. Such beveling or chamfering to form a sharp or "knife" edge or rounding to form a curved edge prevents ice cubes from becoming lodged between a straight edge and the gate 50 and thus holding the gate 50 open. When the edge is beveled, chamfered or rounded, an ice cube in contact with such an edge will be dislodged by the gate 50 and will not block closing of the gate 50. Less preferred, but useable configurations, are flush edges (see FIGS. 12A–12B) or straight edges (see FIGS. 10A–10B).

Figures 36A, 36B, 36C:
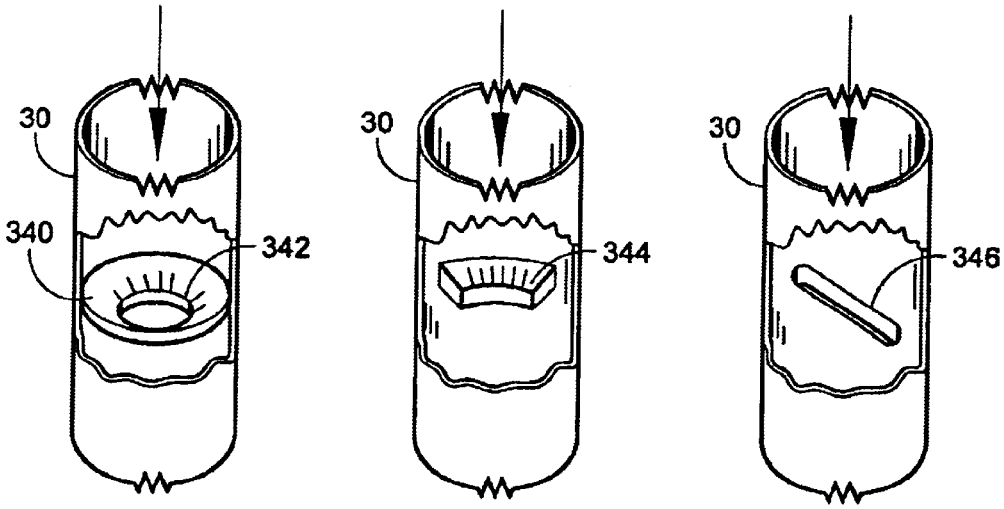
FIGS. 36A, 36B and 36C are partial oblique views showing different configurations of restrictors in accumulators to prevent backward movement of ice.

Occasionally a quantity ice cubes 10 held in an accumulator 30 will act at least in part as a single body, and move backward in the accumulator when the gate 50 is closed and vacuum is reestablished in the accumulator 30. Since it is not desirable to have ice move back into the conduit extension 24*a*, the separator 46 or elsewhere back into the system, it is desirable to install anti-backflow means ("check plate") in the accumulator 46. Three embodiments of such devices are illustrated in FIGS. 36A, 36B and 36C. In FIG. 36A, the check plate is a peripheral lip or flange 340 mounted within accumulator 30 between outlet end 87 and inlet port 28. Preferably the flange 340 is angled in the direction of ice flow, as shown at 342, to enhance the ability of the flange 340 to block backflow of such "unitary" ice cube clusters. The flange 340 need not encompass the entire interior periphery of the accumulator 30, as illustrated in FIG. 36B, but rather may be only a partial protrusion 344 into the interior 44 of accumulator 30. The anti-backflow device need not be in plate form, so that configurations such as one or more rods or wires 346 positioned across the interior 44 of accumulator 30 may also be useful.

Typical examples of systems using single or double accumulators are illustrated in FIGS. 13–17. Also illustrated is the use of a commercial ice maker 6 as the ice source 1 and of a reversible auger 12 as the means for introducing the ice cubes 10 into the ice conduit 24.

In FIG. 13 the ice making device 6 is enclosed in a housing 4. Much of the ice making equipment, such as the refrigerant compressor and condenser and control equipment may conveniently be contained in an auxiliary chamber 8, which may be at the bottom of housing 4 or alternatively at a different location, as at the top of housing 4. The particular type of ice making device 6 is not critical. Many devices are commercially available from a number of manufacturers in a wide range of sizes and capacities, and at various costs, and will be quite suitable. Typical examples are those available commercially from Scottsman Corporation. In such devices ice cubes are commonly formed by flowing water into individual molds, each of the appropriate size for a single ice cube, and then freezing the water to form the solid cubes. Once the ice cubes are frozen, the individual cubes 10 are ejected from the ice maker 6 for collection.

Figure 18:
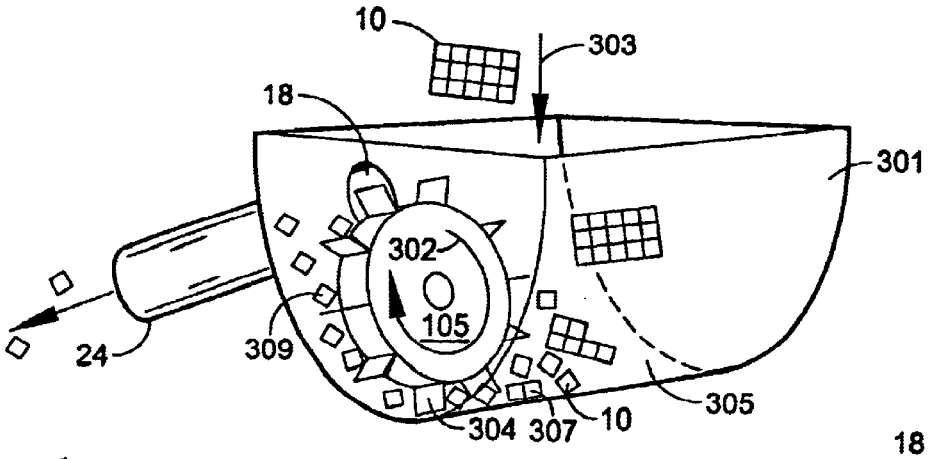
FIG. 18 is an oblique view, with portions cut away or rendered as transparent, of one embodiment of an ice debridging device.

The ejected cubes 10 fall from the ice maker 6 into a transport zone 14 which contains means for delivering the ice cubes individually and without bridging from the outlet port 18 into ice conduit 24. The present system is designed to operate continuously for sustained periods, collecting ice cubes 10 from the ice maker 6 and conveying them through the system to the various intermediate or final dispensing devices. It is common for ice cubes to be bridged (i.e., joined, usually by thin webs of ice) into ice cube clusters when they are ejected from an ice maker such as 6. The cubes must be "unbridged" (i.e., broken apart) in zone 14 or in the port 18 so that they can be introduced individually into conduit 24. Bridged cubes will halt ice flow through the system and requiring shutting down the system to clear the jam of bridged cubes. In addition to the augur 12, FIGS. 18–22 illustrate other types of devices which can be located in zone 14 to unbridge the cubes and deliver them seriatim to the port 18 for entry into the conduit 24. For instance, FIG. 18 shows a toothed or paddle wheel 105 which rotates inside a vessel 301 which is generally V- or U-shaped in cross-section (and which is illustrated as transparent for ease of understanding of operation of the wheel 105). Wheel 105 may be rotated manually or by a motor (not shown) or other conventional means. Ice 10 enters the vessel 301 as bridged ice cube clusters as shown by arrow 303, which move toward the bottom 305 of vessel 301. In part during their downward movement, and then fully as they move under and around wheel 301 at 307 and 309, the ice clusters are broken up into individual ice cubes 10. Rotation of the wheel 301 as indicated by arrow 302 moves the individual ice cubes to port 18 where they are discharged into conduit 24 by the action of wheel 301 and the vacuum in conduit 24. The paddles or teeth 304 on wheel 301 may be angled toward port 18 to facilitate discharge of the ice cubes 10 through port 18 if desired.

Figure 19:
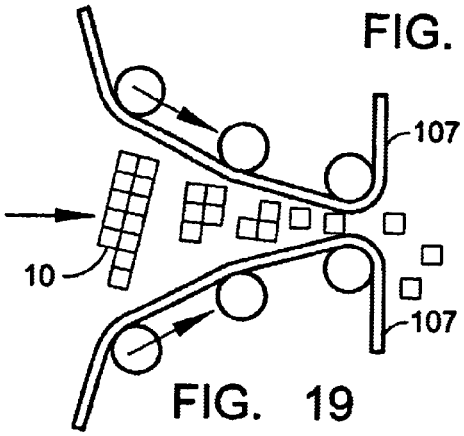
FIGS. 19–22 are schematic views from the top or side showing other embodiments of ice debridging devices.
Figure 20:
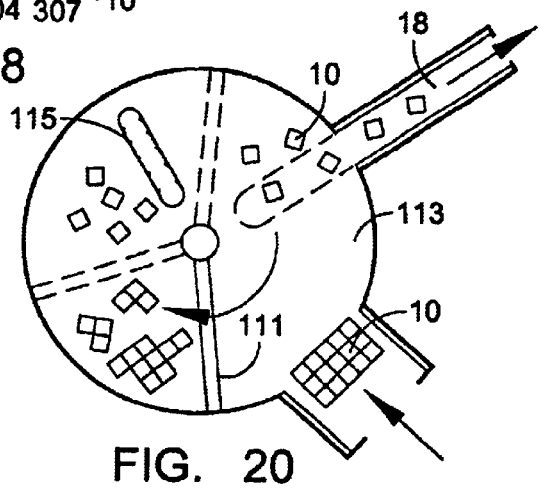
Figure 21:
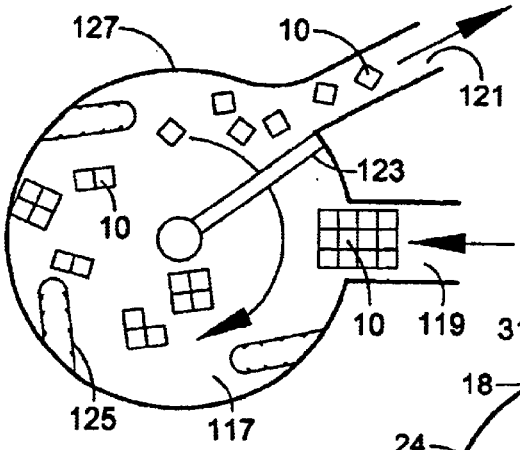
Figure 22:
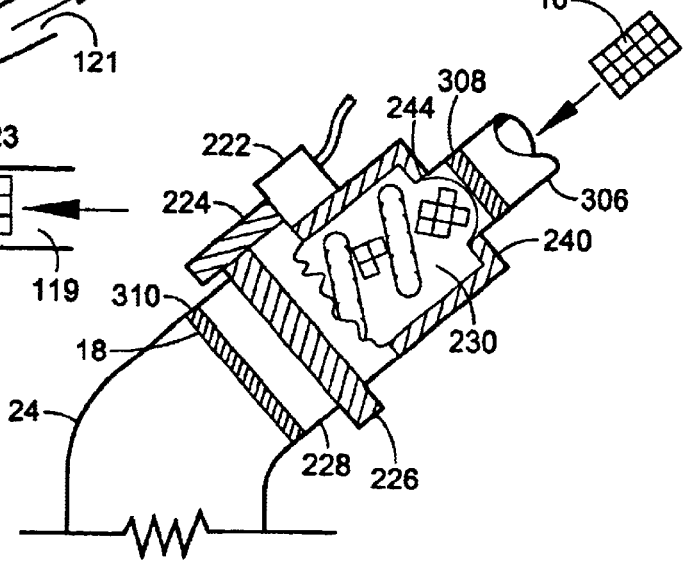

19 FIG. 19 shows angled or parallel belts 107 which force the bridged ice 10 between them and in doing so, cause the bridged ice clusters to break up into individual cubes 10, which are then discharged from between the belts, eventually reaching port 18 or its equivalent conduit 24 entry. In FIG. 20 a bar 111 moves over a flat surface 113 dragging and tumbling the ice 10 to unbridge it and drop the separated cubes into port 18 (shown as a chute down which the cubes travel into conduit 24). The effectiveness of the device can be enhanced by slightly corrugating the surface 113 or putting protrusions 115 on it. FIG. 21 is a device similar to that of FIG. 20, being a bowl 127 with a rapidly rotating bottom 117 into which bridged ice is slid or dropped from entry 119. As the ice is moved around, centripetal force moves it to the perimeter of the bowl 127 where it breaks apart, and it is then carried to exit chute 121 and ejected by the same centripetal force. A barrier 123 may be placed at or just past exit 121 to prevent ice cubes from being trapped in the bowl 127. Protrusions 125 may be placed in the bowl to aid in unbridging the ice by providing impact points for the ice as it moves with bottom 117. FIG. 22 shows an ice tumbler 240 which has a rotating hollow cylindrical body 228 which is open at exit end 242 for discharge of the ice into or through port 18 to conduit 24. Bridged ice 10 is transferred through port 306 into tumbler 240. Tumbler 240 rotates about its cylindrical axis, driven by motor 222 and gear 224, which meshes with circumferential ring gear 226 which is mounted on the outside of body 240. Rotation of tumbler 240 involves use of rotational bearings 308 and 310 between tumbler 240 and the adjacent stationary conduits 306 and 24. As the ice moves through the interior 230 of tumbler 240, it repeated strikes interior baffles 244, so that by the time it reaches the discharge end 242 leading into port 18, it has been separated into individual cubes which can move on into conduit 24. Other debridging devices will be familiar to those skilled in the art, and all such devices are to be considered useful within the scope of this invention.

In the embodiment shown in FIGS. 13–17, the unbridging device is reversible auger 12. The direction of travel of auger 12 is controlled by reversible drive motor 20 and indicated by arrow 22. When the system is operating to convey ice to the remote receptors, the auger 12 will be run to deliver ice 10 to the outlet 18; operation in the reversed mode will be described below.

At the outlet end 28 of conduit 24 is accumulator 30, which is shown in more detail in FIG. 14. As has been described above, connected to line 24 at separator 46 close to end 28 and accumulator 30 is vacuum line 32 which is connected to vacuum pump 34. Ice cubes 10 are moved by auger 12 from auger zone 14 and delivered through outlet port 18 into conduit 24, where they are caught in the moving air stream and are entrained in and pulled along with the air flow under the vacuum created by vacuum pump 34, and thus moved through conduit 24 to accumulator 30.

As the ice cubes 10 reach the outlet end 28 of conduit 24 at accumulator 30, their momentum separates them from the air stream in separator 46 and they pass into chamber 44 within accumulator 30 through inlet 42, while the air flows into vacuum line 32 to vacuum-pump 34, from which it is discharged to the ambient surroundings. Accumulator 30 operates to hold and release the cubes 10 as described above.

In another embodiment shown in FIGS. 13 and 14, there is a "double accumulator" configuration. This configuration is most conveniently used when accumulator operation is pneumatic. The ice cubes exiting from accumulator 30 through gate 50 fall into chamber 54 within intermediate receiver 56 (i.e., a second accumulator) as indicated at 10'. Intermediate receiver 56 is mounted so as to surround the lower end 48 and gate 50 of accumulator 30. Gate 60 of receiver 56 is normally held open by its own weight. When gate 50 opens by the weight of ice 10, a vacuum is created in receiver 56 which pulls gate 60 closed. Once sufficient ice 10 has fallen from accumulator 30 into receiver 56 to allow vacuum pump 34 to reclose gate 50, that breaks the vacuum in receiver 56 and releases gate 60. Gate 60 then immediately opens under its own weight and releases ice 10' to drop into and through receiver 53 into a receptor, in this case ice dispenser or IBD 66. The movement of ice from accumulator 30 to accumulator 56, and the resulting rapid closure of gate 50 and opening of gate 60, allows the present system to maintain essentially a continuous vacuum in the conduits 24 such that ice conveyance continues virtually uninterrupted. As with accumulator 30, intermediate accumulator 56 may have a liquid drain line 74 with an end gate 38 which, like gate 60, is held closed when there is vacuum in the accumulator 56. When the vacuum is broken by opening of gate 60, drain gate 38 opens of its own weight to allow accumulated water from chamber 54 to flow out through drain 74 to a liquid discharge (not shown). Normally, however, water presence in the system is not a major concern.

The noise of the ice 10 arriving at the discharge port is substantially reduced in a vacuum system, as compared to prior art positive pressure systems, because the chambers 30 and 56 release the ice into the dispenser without the high velocity air noise of air under elevated pressure.

FIG. 15 illustrates a different and more complex system 76. In the system 76 an additional downstream accumulator 78 and ice conduit 80 are used and the initial discharge of ice directly from accumulator 30 or indirectly through intermediate receiver 56 or dispenser 66 is to the downstream conduit 80 and then to accumulator 78. Vacuum pump 34 is in fluid communication through vacuum line 82 with accumulator 78. Accumulator 78 operates in the same manner as accumulator 30 and may be used in conjunction with second intermediate receiver 84 to discharge into a dispenser 86 through receiver 88, from which ice can be withdrawn through discharge chute 90 in a manner as described above.

An important application of the system of FIG. 15 is based on its ability to allow movement of ice from one dispenser to another. Thus, in a preferred embodiment, dispenser 66 is a large capacity dispenser (e.g., up to about 300 pounds [135 kg] of ice) and dispensers 86, 86', 86" and 86'" are smaller dispensers, particularly terminal dispensers from which the end users obtain ice. An inlet 177 to ice conduit 80 is positioned below the outlet ice chute 68 of intermediate, or storage, dispenser 66. A vacuum line 82 connected to vacuum pump 34 is connected to ice conduit line 80 at 179, in like manner as the connection of vacuum line 32 to ice conduit 24 through separator 46. Ice can then be released from dispenser 66 to fall into the inlet 177 of conduit 80, and is then conveyed to accumulator 78 through conduit 80 under vacuum from line 82. Dispenser 66 may have an internal auger or other unbridging device (as described above) to aid in the dispensing of the ice and, as in zone 14, insure that the ice is delivered unbridged from the inlet 177. Control of the vacuum in lines 32 and 80 is through gate valves 181 and 183, respectively. These valves may be manually operated or operated automatically through controller 122, as described below. The ability of the storage dispenser 66 to convey ice to a number of different downstream dispensers is illustrated in FIG. 15 by the alternative indication of dispensers 86', 86" and 86'", with their corresponding inlets 88', 88" and 88'" and outlet chutes (only 90' is shown). Each separate dispenser 86', 86" and 86'" would have its own corresponding ice conduit 80, vacuum line 82 and control valve 183. The dispensers 86', 86" and 86'" may have internal sensors for determining the volume or weight of ice in each dispenser, and operation of the respective replenishment system may be automatically determined and performed by an electronic control system such as one including controller 122 as discussed below. Intermediate storage of large quantities of ice for further conveying to local terminal dispensers can insure availability of ice for customers in locations such as fast food restaurants where for short periods (e.g., lunchtime) there is a high demand for ice, without taxing the ice production capacity of the ice maker 6 or the transport conduits 24 with the need for rapid replenishment of ice.

Yet another embodiment is illustrated in FIG. 16, which shows a system which is essentially a combination of system 2 and a parallel alternative system 92. In this embodiment, vacuum pump 34 is positioned within the auger space 14 and has a main vacuum line 94 extending to tee 96. One leg of tee 96 has an exit vacuum line 98 which connects with valve 100 to which vacuum line 32 is connected. Thus, in a normal embodiment with auger 12 being operated to move ice cubes toward outlet port 18, the same operation of system 2 occurs as has been described above. Alternatively, however, the rotation of auger 12 can be reversed, causing ice cubes to be moved toward outlet port 16. The cubes 10 drop through outlet 16 into conduit 108 of system 92 through which they are conveyed to a different accumulator 110 (which may be used in conjunction with a different intermediate receiver 112) and from which ice cubes eventually reach inlet 114 of ice container 116, from which the ice can be dispensed in small quantities through discharge chute 118 in a like manner to the operation of system 2. The vacuum motive force for system 92 is obtained also from vacuum pump 34 through main vacuum line 94 and tee 96. A second vacuum line 102 is mounted to another branch of tee 96 and connects valve 104. Valve 104, in turn, is connected to vacuum line 106 which draws the vacuum through accumulator 110.

Figure 17:
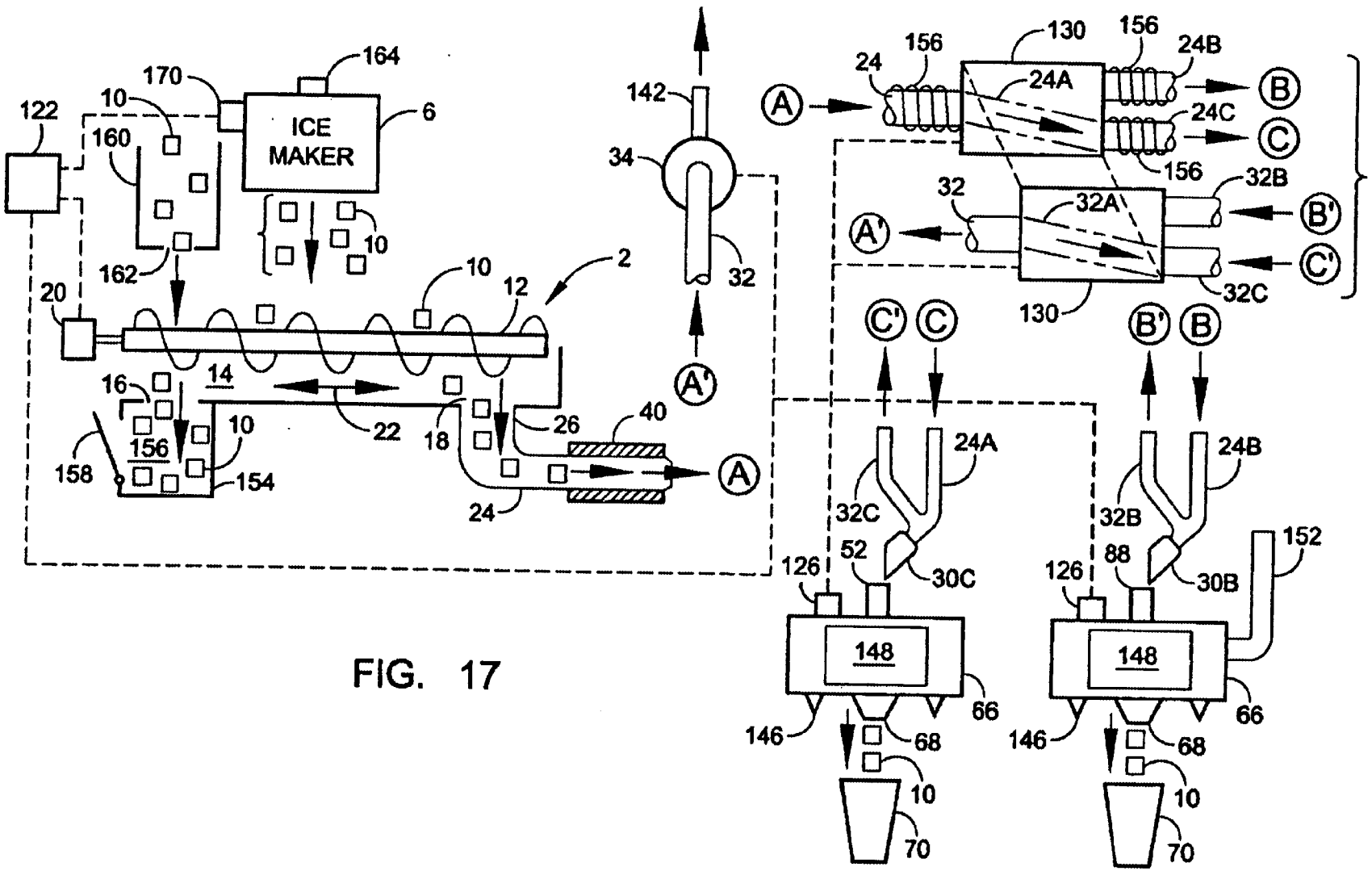

FIGS. 16 and 17 also illustrate schematically a typical installation in which the system may be controlled by controller 122 acting through electrical signal lines indicated by dashed lines. The controller 122 may control singly or in desired groups valves 100 and 104 to respectively open and close the vacuum lines 32 and 106, may control the operation of ice maker 6, the pump 34, the direction and speed of auger 12 through motor 20, and may also allow systems 2 and 92 to be isolated from each other. Operation of the various system devices may be determined by the feedback through the dashed electronic signal lines from sensors 126 and 128 which monitor the ice supply in dispensers 116 or 66. The signals from the sensors indicating the amount of ice in the dispensers may also be used to determine which system 2 or 92 is activated to convey ice to a depleted dispenser. It will be evident that the same computer controls and signals can be extended to additional systems or circuits in addition to systems 2 and 92 (with the additional systems being not shown). These and other applications of the controller 122 within the system will be readily determined by those skilled in the art for use of any of the various embodiments of the present system.

As noted above, the base air pressure against which the vacuum is to be measured is the ambient atmosphere surrounding the system. Normally the vacuum (commonly referred to as "negative pressure") is measured based on ambient pressure being designated as gauge pressure rather then absolute pressure. Therefore, with a base of 0 psig (0 $kPa_{gauge}$), the vacuum drawn by the vacuum pump 34 will reduce the pressure in the system to the range of −2.0 to −13.0 psig (−12 to −89 $kPa_{gauge}$). Optimum vacuum for most systems will be in the range of −4.7 to −12.7 psig (−31 to −86 $kPa_{gauge}$). Those skilled in the art will readily be able to determine the appropriate vacuum to use in any particular system of interest. The factors involved in the degree of vacuum which must be maintained will include the length of runs of the ice conduits, the quantities of ice to be transported, the size of available conduits, the number of branches and turns in the conduit system and the systems changes in elevation, and the like, all of which factors determine the size of the vacuum pump(s) needed, and are well known to those skilled in the art.

A further embodiment showing an overall complete system (with the portions separated for clarity) is shown is FIG. 17. Two separate routes [B/B' and C/C'] are shown diverging through the diverter/shifter 130 (which is shown schematically separated to illustrate separately the routing of the ice flow [A, B, C] and the vacuum [A', B', C'] in parallel through the diverter/shifter, as will be discussed further below.) The auger 12 is reversible as indicated by arrow 22. Ice cubes 10 from ice maker 6 drop into the auger zone 14 and can be conveyed in one direction to and through outlet 18 into conduit 24 as indicated by arrow 26. The ice maker may also contain an alternate storage unit 154 for temporary storage of ice when the ice maker continues to run but there is no immediate demand for ice in either of the ice dispensing devices/IBDs 66. The auger 12 then moves in the opposite direction to outlet 16, through which the ice 10 drops into the storage unit 154. A door 158 opening into the interior 156 of storage unit 154 allows for access to the accumulated ice and manual removal. When subsequently needed, the ice can be manually removed from unit 154 and passed to hopper 160 from which it can be reinserted into the auger zone 14 through opening 162. If desired, manual mechanical or pneumatic means can be used to transport ice from storage container 154 to hopper 160 for reinsertion into the auger zone 14 and transport by the auger (running in a forward direction) to the conduit 24. This type of operation is particularly useful at night when there is little demand for ice by patrons of restaurants or hotels, but a strong demand is expected the following morning.

It is also useful during periods of extremely heavy use (such as a peak meal hour at a fast food restaurant) the patron demand for ice will be cause ice to be drawn from a dispenser 66 at a faster rate than ice maker 6 can produce ice cubes 10, and where an intermediate storage supply dispenser such shown in FIG. 3 is not available. To avoid depletion of ice in the dispenser 66 one can provide temporary manual insertion of ice cubes 10 from bin 154 into the auger 12 from feeder 160 through entry 162, as noted above. The auger 12 will then transport the inserted ice for entry into the conduit 24 and conveyance to the dispenser 66 in the normal manner. This storage and re-feed capability also allows the system to continue to function if the ice maker 6 temporarily fails for some reason.

Figure 23:
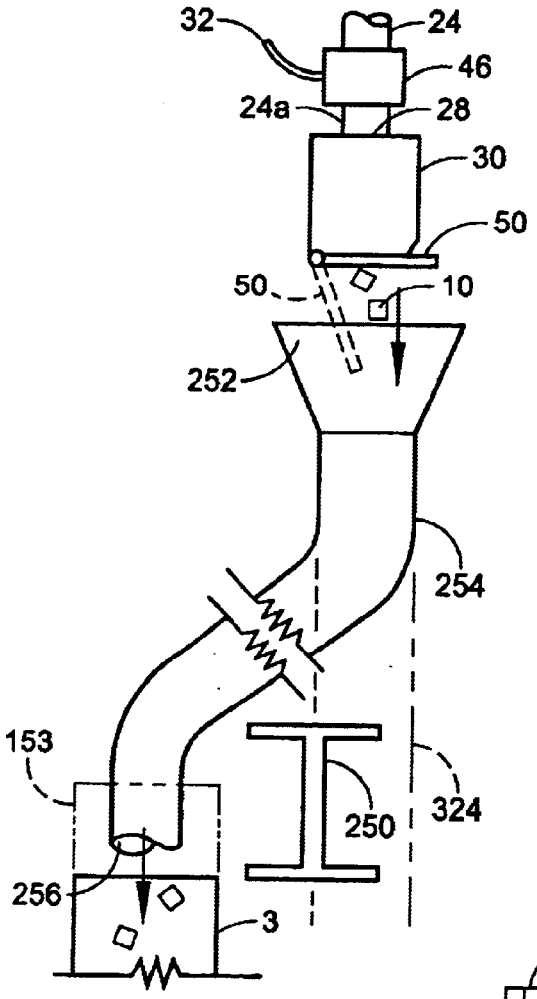
FIGS. 23–24 are side elevation views of curved conduits which may be used when structural components of the building in which a system is installed impair connections to and access between different portions of the system.
Figure 24:
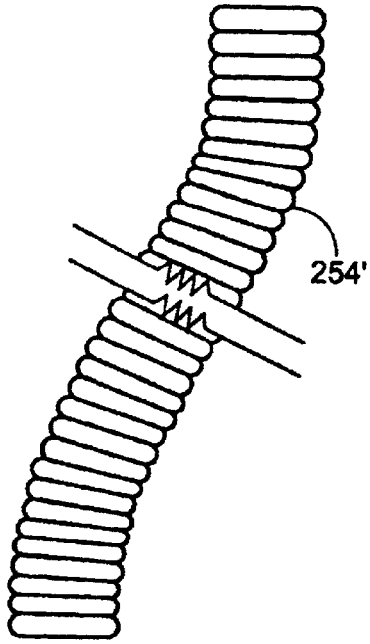
Figure 34:
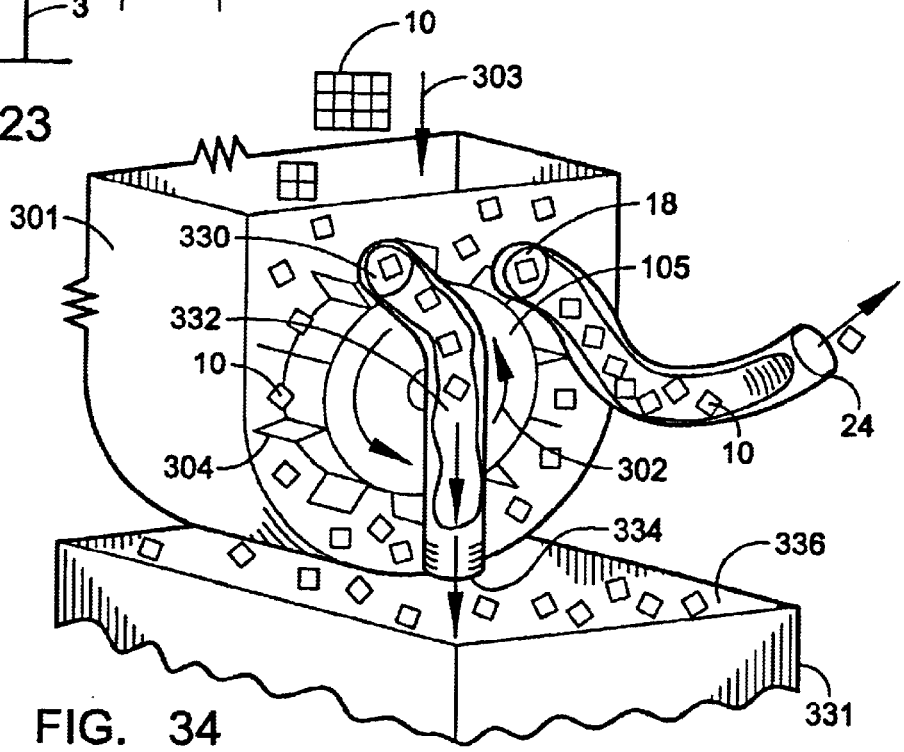
FIG. 34 is an oblique view similar to FIG. 18, with portions cut away or partially transparent, showing yet another embodiment of an ice debridging device, in connection with alternative routing of ice into the system or into storage.

FIGS. 23, 24 and 34 illustrate various means for installing a system of this invention in confined spaces or when structural elements of the building preclude direct alignment of the end 28 of conduit 24 and the target receptor 3. In FIG. 23 such a situation is indicated by the presence of joist or girder 250 which prevents conduit 24 from terminating directly over receptor 3 (as would otherwise be the case, as suggested by alignment lines 324. In the exemplary solution to the problem, accumulator 30 is attached to conduit extension **24*a* and ejects ice 10 through gate 50 into the inlet end 252 a curved ice conduit 254. Conduit 254 is curved in a manner such that the outlet end 256 of conduit 254 is positioned directly over the inlet of receptor 3, which may be within receiver 153**.

The conduit 254 may be made of sheet metal or rigid plastic and be fixed in position, or it may be made of corrugated or flexible metal or plastic (as shown at 254' in FIG. 24) and be bendable to be placed in position. In these embodiments the orientation of the conduit 254 must be generally vertical so that the cubes 10 discharged into entry 252 will moved generally by gravity through conduit 254 and into receptor 3.

FIG. 35 shows another embodiment designed for use in low clearance locations. An ice receiver or storage bin 312 is placed under counter 314 resulting in restricted clearance between floor 313 and the underside of counter 312. In order to accommodate the low clearance, accumulator 30 is set at an angle where it enters the side 315 of bin 312 to enable discharging of ice 10 into the interior 316 of bin 312. Conduit extension **24*a* may be curved if needed to reach separator 46, which is positioned at a location under counter 314 which permits room for both ice conduit 24 and vacuum line 32 to run essentially horizontally under counter 312 until they pass out from under counter 312** (not shown).

Figure 25:
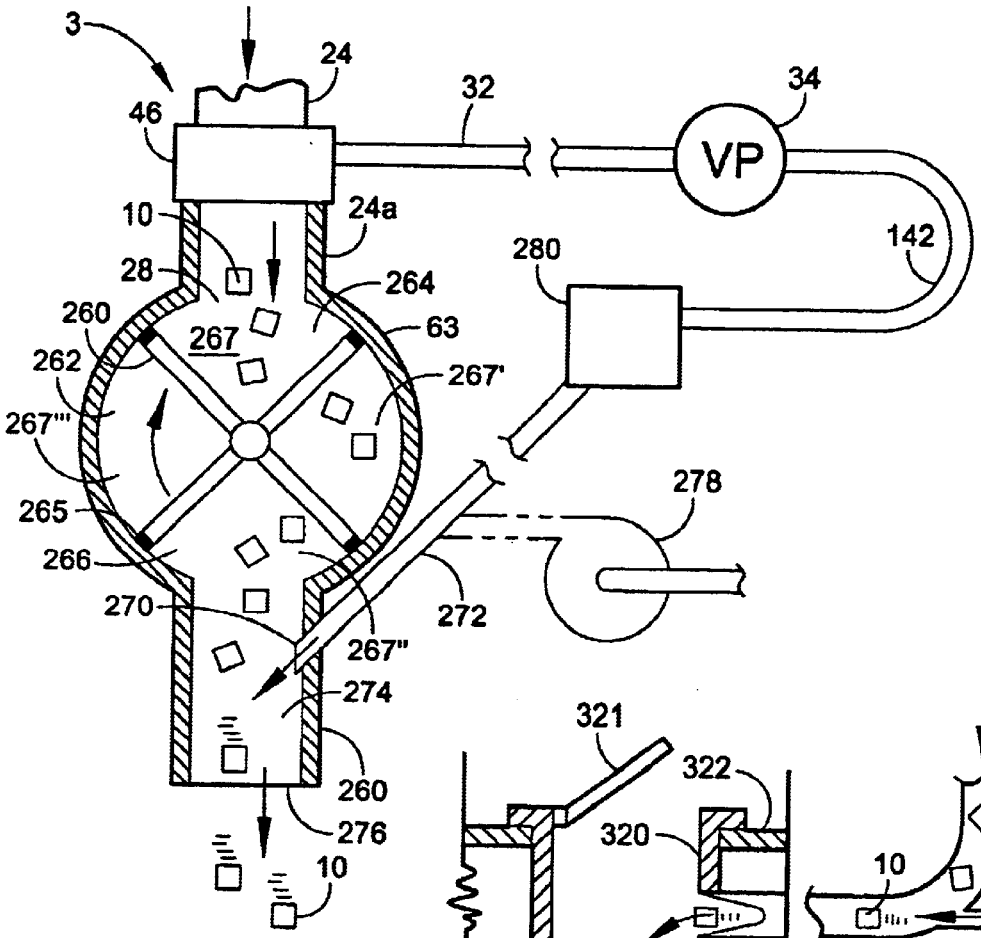
FIG. 25 is a side elevation view illustrating an embodiment incorporating an air lock device.

FIG. 25 shows a different embodiment of the system in which the ice cubes 20 pass through an air lock device 63. Use of air lock device 63 permits a number of different beneficial functions to be incorporated into the system. In one embodiment, illustrated in FIGS. 4 and 25, ice cubes 10 can be projected in any desired direction, including upward, to deliver the cubes 10 to any portion of a target area. The air lock 63 structure is conventional, with a cylindrical internal chamber 262 with a multi-blade divider 260 rotating within the chamber and dividing it into an equivalent number of moving segments such as 267. Normal practice requires that there be at least 4 segments (although there may be more), and the segments must be sealed from one another as by seals 265 so that negative air pressure in conduit extension 24*a* and the inlet zone 264 of air lock device 63 is pneumatically sealed from elevated air pressure in the outlet zone 266 and discharge conduit 268. Ice 10 enters inlet zone 264 from conduit extension 24*a* and is deposited in the segment (e.g., 267) which is then disposed in inlet zone 264. As the divider 260 rotates (powered by a conventional motor, not shown) the segment 267 moves (as indicated by 267' and 267") and the ice 10 contained in that segment is moved around the interior chamber 262 to the outlet area 266 where the ice 10 is exits that segment and passes into outlet conduit 268. The emptied segment then continues to move as indicated at 267'" and arrives back at port 28 where it is filled with additional ice 10, so that the cycle repeats. The same sequence has of course also been occurring with the other segments formed by divider 260.

An outlet end 270 of high pressure air line 272 projects into conduit 268 so that as the ice 10 reaches region 274 of the interior of conduit 268 it is subjected to the full force and velocity of high pressure air exiting from outlet 270 of conduit 272. This substantially increases its velocity and momentum as it is ejected through outlet 276 of conduit 268, so that it is traveling at high speed and can be projected a substantial distance from the outlet 276. The high pressure air may be supplied by a convention air compressor or blower 278, but preferably will be taken from the exhaust of vacuum pump 34 through line 142 and suitable valving device 280. Most commonly a flexible conduit or hose 282 will be attached to the end of conduit 268 (see FIG. 4) so that the high velocity ice can be directed in any desired direction for collection. This embodiment is well suited for tasks such as filing large ice containers, bins or rooms; filing the ice bins of vehicles such as catering trucks; covering frozen food, medicine, etc. packages already in a container with ice; and so forth.

Figure 25A:
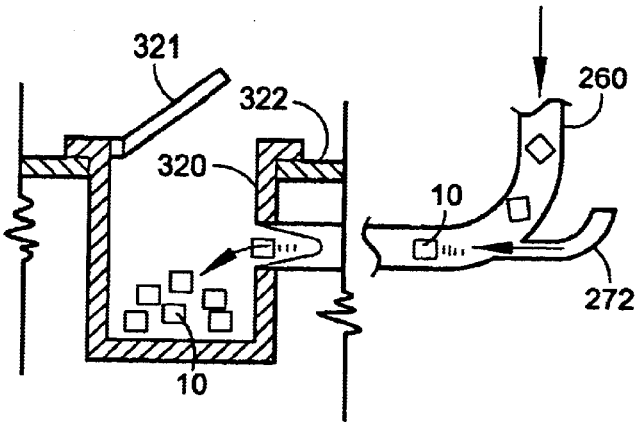
FIG. 25A is a partial side elevation view, partially in section, illustrating a modification of the embodiment shown in FIG. 25.

The air lock device 63 can be used for a number of other functions. For instance, as illustrated in FIG. 25A, the system may be configured to allow the high pressure air from air line 272 to blow the ice cubes 10 into a drop-in bin 320 which is set into a counter 322, such as may be used in a restaurant, hotel or hospital. Ice 10 may then be manually retrieved by the use from bin 320 such as by lifting lid 321 and scooping ice into a container such as ice bucket 70' (see FIG. 33). This embodiment may, for instance, be used in place of the embodiment shown in FIG. 35, such as where the ice conveyance system, including the air lock 63 receptor, are on the other side of a wall (not shown) from the bin 320. In such a case, the conduit 260 can penetrate the wall through a hole no bigger than that conduit, and the ice can be blown through the conduit 260 into the bin 320. Other embodiments and functions have been mentioned above, and still others will be readily apparent to those skilled in the art.

FIG. 34 relates to FIGS. 17 and 18 and illustrates an embodiment in which an unbridging paddle or toothed wheel 105 can be used to automatically divert ice cubes 10 to storage when they are not needed for distribution through conduit 24 to receptors 3, as discussed with respect to FIG. 17. Such, for instance, could be during nighttime when an ice supply can be stored for use during the next day's high demand periods to supplement the ice then being supplied from ice source 1. Thus a restaurant could store ice at night and have it available the next at lunch time or dinner time when ice demand may temporarily exceed the supply capability of the ice source 1. In this embodiment, after the ice clusters have been unbridged into individual cubes 10, the cubes 10 are rotated around to port 18 as described above for FIG. 18. If the vacuum supply to conduit 24 is shut off, there is be no motivating force to divert ice cubes 10 into conduit 24 through port 18 except gravity or the motion of paddles 304. Unless a closure (not shown) is provided for port 18, a small number of cubes will pass into the inlet portion of conduit 24 adjacent to port 18, as shown, but those cubes will soon stop moving without the vacuum present and the inlet end of the conduit 24 will become filled with stationary cubes. Further unbridged ice cubes 10 will then be moved past port 18 by wheel 105 to a second port 330, which opens into a second conduit 332 whose outlet end 334 opens over the interior 336 of storage bin 331. The ice 10 will be diverted by the wheel 105, paddles 304, and usually gravity, into the conduit 332, from which they will fall into the interior 336 of bin 331. They can subsequently be retrieved for use to supplement later ice supplies from ice source 1, as described with FIG. 17.

FIGS. 26A–26B, 27A–27B and 28A–28B illustrate three versions of a unique combination ice diverter/air shifter 130 which can be used to direct the conveyance of ice and drawing of vacuum simultaneously over alternate routes as shown graphically in FIG. 3. (Diverter/shifter 130 may be any of the diverter/shifters identified as 9', 19' and 29' in FIG. 3.) The basic concept will be illustrated with respect to FIGS. 28A–28B, which show the diverter in its "four route" configuration. The paired conduits (vacuum line 32 and ice transport conduit 24) are attached to ports 131 and 131' which pass through the wall of housing 132 of the diverter/shifter 130. Within the housing 132, ports 131 and 131' are connected respectively to the adjacent ends of flexible ice conduit 24A and flexible vacuum line 32A. The flexible ice conduit 24A and vacuum line 32A cross the interior of housing 132 and are connected at their opposite ends to slider 135 through ports 137 and 137'. Slider 135 traverses back and forth parallel to wall 143 of housing 132, in guide 139, as indicated by arrow 145. Shifter 135 has a pair of apertures aligned with the ends of ice conduit 24A and vacuum line 32A and their respective ports 137 and 137'. In this embodiment of FIGS. 28A–28B, there are four alternate ice conveyance routes B, C, D and E shown. Each has its own ice conduit 24B, 24C, 24D or 24E and corresponding vacuum line 32B, 32C, 32D or 32E. The pairs of ice conduit and vacuum line are attached to respective pairs of ports 141B, 141C, 141D and 141E, which pass through wall 143. The inside ends of each pairs of port 141B, 141C, 141D or 141E align with a corresponding pair of apertures in guide 139, each of which aperture pairs also aligns with the pair of apertures in slider 135 when slider 135 is moved to align ice conduit 24A and vacuum line 32A with the corresponding ice conduit and vacuum line leading to routes B, C, D or E.

Movement of slider 135 may be manually, mechanically or electrically controlled. More preferably, however, the traversing movement of slider 135 will be produced pneumatically by gas pressure. Gas for the movement is provided from gas source 151. There are two gas lines, one of which moves the slider from B→C→D→E, and the other of which moves it back in the opposite direction. The B-C-D-E direction movement is illustrated in detail in FIG. 8A. Gas from source 151 passes through line 220 and valve 169 to triple valve 155. For the B-C-D-E direction, triple valve 155 is aligned so that the gas passes through nipple 157 which penetrates wall 158 of housing 132, and on the opposite end of which is fixed one end of flexible gas line 159*a*. The other end of gas line 159*a* is attached to nipple 161 which is attached to one end of slider 135. Pressurized gas from source 151 passes through line 159*a* to slider 135 and drives slider from the B route alignment to the C route alignment to the D route alignment to the E route alignment by conventional means (not shown) cooperating with guide 139. Triple valve 155 also is connected to line 163 which leads through valve 165, line 167 and nipple 171 to flexible gas line 159*b*. Returning the slider in the E-D-C-B direction is achieved by realigning triple valve 155 so that the driving gas passes to gas line 159*b*, which then moves slider 135 in the reverse direction. Alignment of the slider 135 and flexible conduit 24A and line 32A with the respective B, C, D and E route conduits and lines when traversing in either direction can be determined by appropriate sensors and associated sensor-driven indicators (not shown), especially if control is automatic, or visually, as by having an indicator mounted on the slider and corresponding indicators aligned with each pair of B, C, D and E route ports, with both indicators visible though a viewing window (not shown) in a wall of housing 132, for manual control of slider 135. The gas flow and therefore movement of slider 135 are controlled by manipulation of valves 155, 165 and 169, either manually or automatically, to cause directional movement of the slider and stopping when aligned with the desired route conduit and line pair. Although compressed air may be used, preferably the gas will be carbon dioxide supplied under pressure from a tank, cylinder, tube trailer or $CO_2$ generation system. This is particularly preferred in restaurants and similar facilities where beverages are dispensed, since many beverage dispensers are either operated by pressurized $CO_2$ or have pressurized $CO_2$ injected into beverages to provide carbonation, and therefore such facilities have substantial pressurized $CO_2$ gas supplies on hand.

FIGS. 26A–26B and 27A–27B show analogous versions of the diverter/shifter 130 for, respectively, two and three route diversion. While these are shown for ease of understanding as separate versions, it will be understood that FIGS. 26A–26B also represents operation of a slider 135 of a three- or four-route diverter/shifter 130 between two routes and FIGS. 27A–27B also represents operation of a slider 135 of a four-route diverter/shifter 130 among three routes. The four-route diverter-shifter 130, with its ability to handle two- and three-route movements, represents a major improvement over prior art sliding diverters, which cannot operate with more than three possible routes.

It will be noted that the ice movement in the ice conduits 24, 24A, etc. and the air flow in the vacuum lines 32, 32A, etc. are in opposite directions, as shown by the arrows marked on each conduit or line. Therefore, what is the inlet end of the diverter/air shifter 130 for ice is the outlet end for air, and vice versa. The ice conduit 24A and vacuum line 32A will be sufficiently flexible (and compressible as necessary) to avoid kinking during the slider 135's traverse and also to avoid offering resistance sufficient to impede the movement of slider 135, but ice conduit 24A must yet not be so flexible or compressible that movement of ice through the conduit is impaired. Further, while housing 132 is shown with various walls, the diverter/air shifter does not require an entire closed housing, but may be simply a framework having sufficient structure to maintain the various components in alignment. Visual indication of slider positioning is of course simpler in such a configuration. The system also anticipates that additional divergence to further routes may be provided by using two or more diverters/shifters in series.

Figure 29:
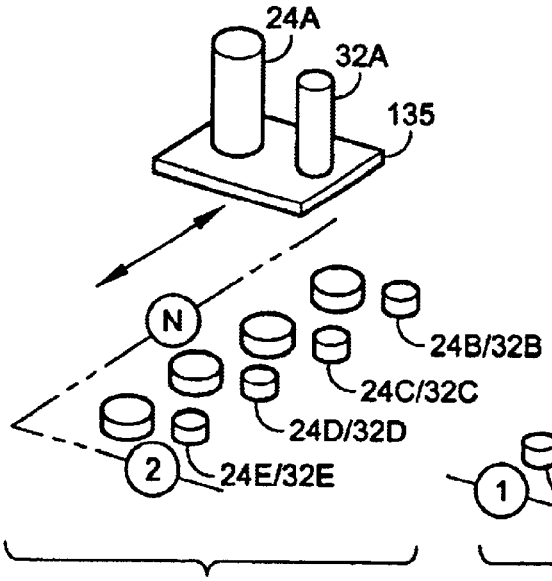
Figure 30:
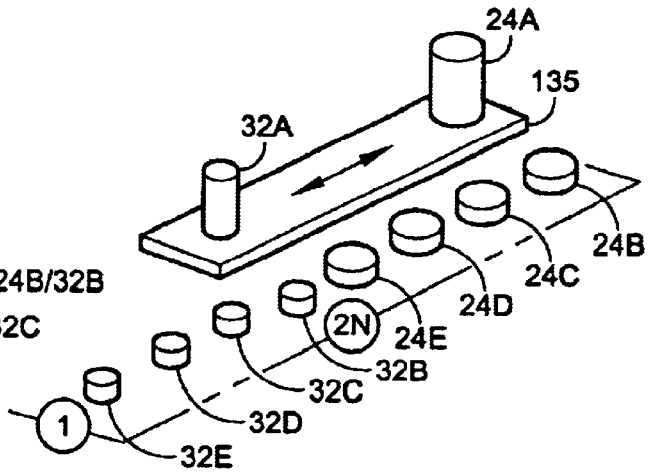

FIGS. 29 and 30 illustrate two embodiments of the diverter/shifter 130 to accommodate normal installation areas or installation areas with limited space. In FIG. 29 the route B, C, D, E conduit pairs are aligned in parallel in a 2×N array, with N being the number of pairs. This is the preferred configuration and will be used where sufficient installation space is available. In many cases, however, installation space is confined and shallow. Installation in such areas is illustrated in FIG. 30, in which the vacuum lines 32B, C, D, E are separated from their respective ice conduits 24B, C, D, E and all are arranged in a 1×2N array, in which N is again the number of 24/32 pairs. The configuration of the slider 135 and its 24A/32A pair will be adjusted accordingly, as illustrated.

In addition, operation of the system will be aided by installing all conduits with a slight downward slope so that any water in the system, as from melting ice, will drain out the end of the conduit. Where there are relatively long runs, so that the overall downward deflection of the system would be excessive, laying out the system so that paired adjacent portions slope downward toward each other, with a drain such as drains 72 and 74 (FIGS. 13 and 14) at each low point, so that water can accumulate and such low points and be drawn off through the drain.

Figure 31:
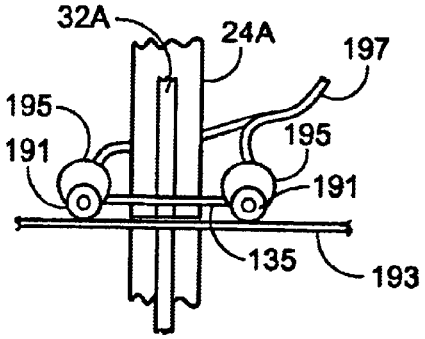
FIGS. 26A–32 are side elevation or oblique views illustrating various aspects of the structure and operation of the diverter/shifters of the present invention.
Figure 32:
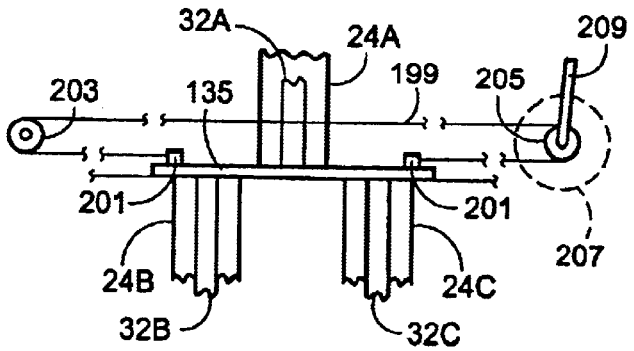
Figure 26A:
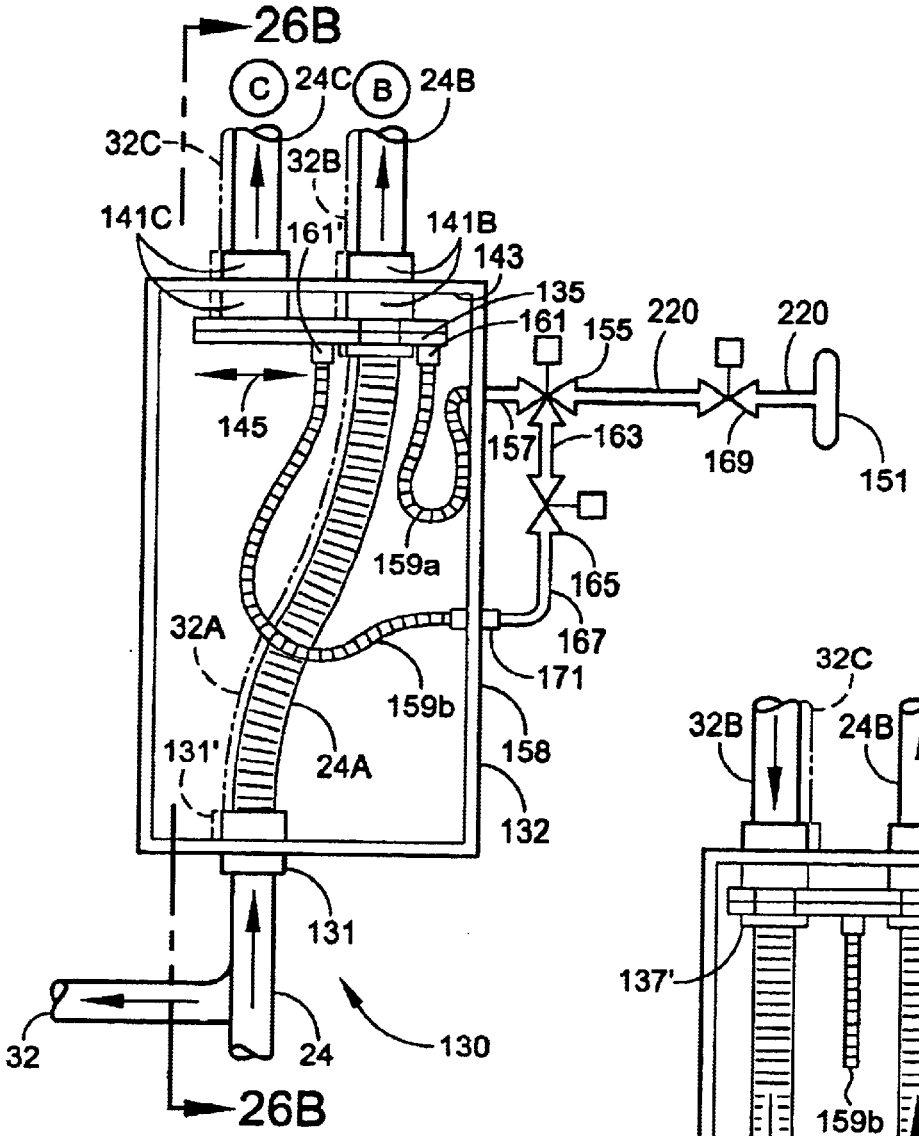
Figure 26B:
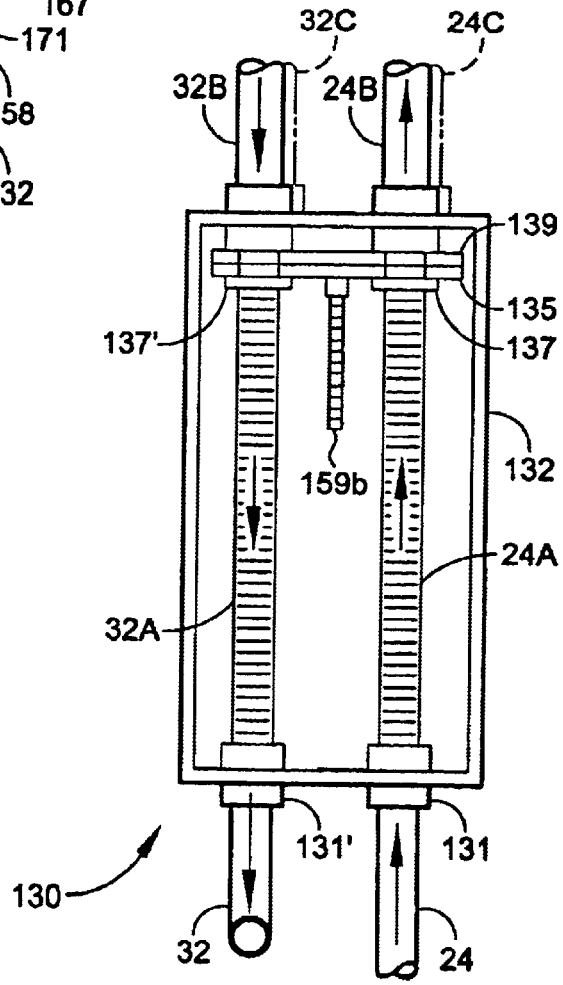
Figure 27A:
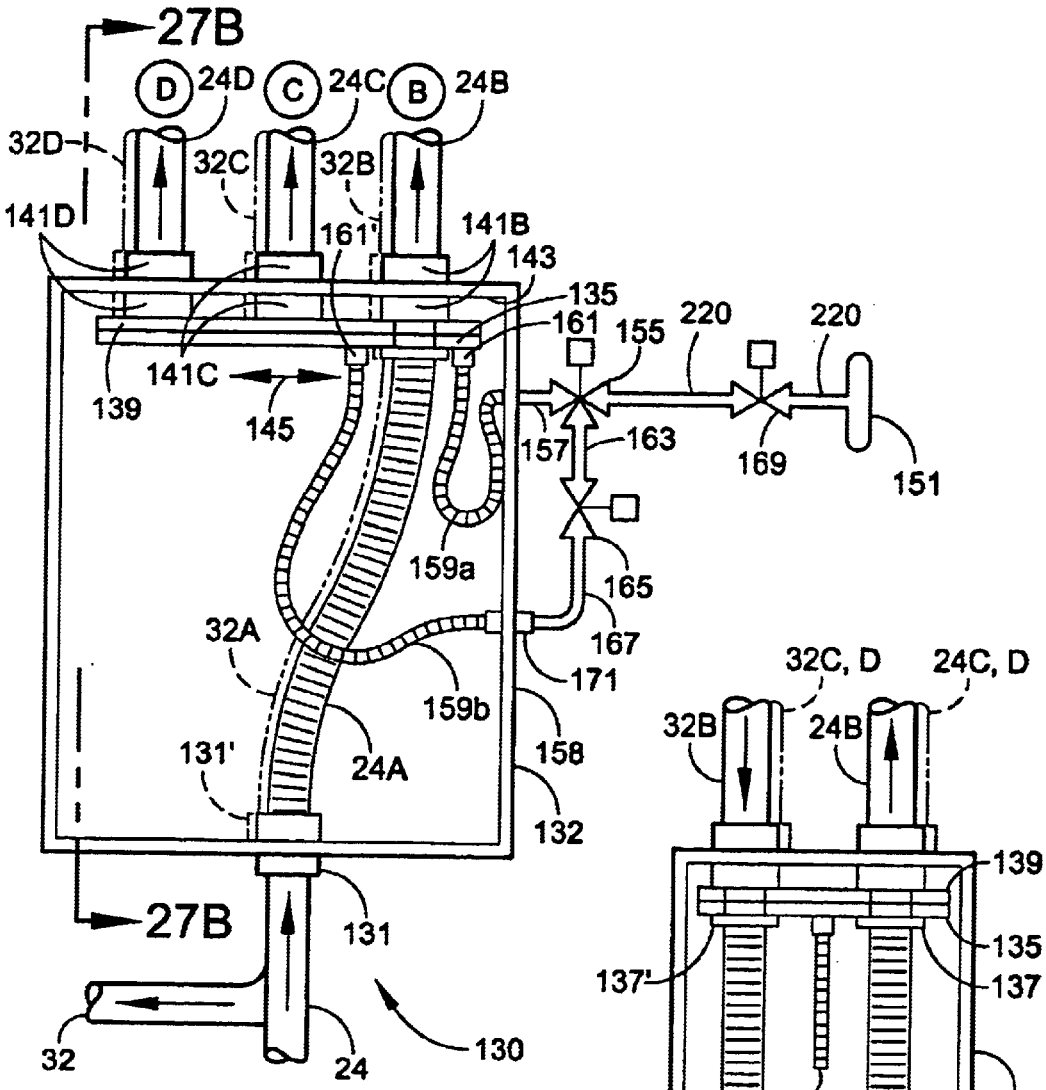
Figure 27B:
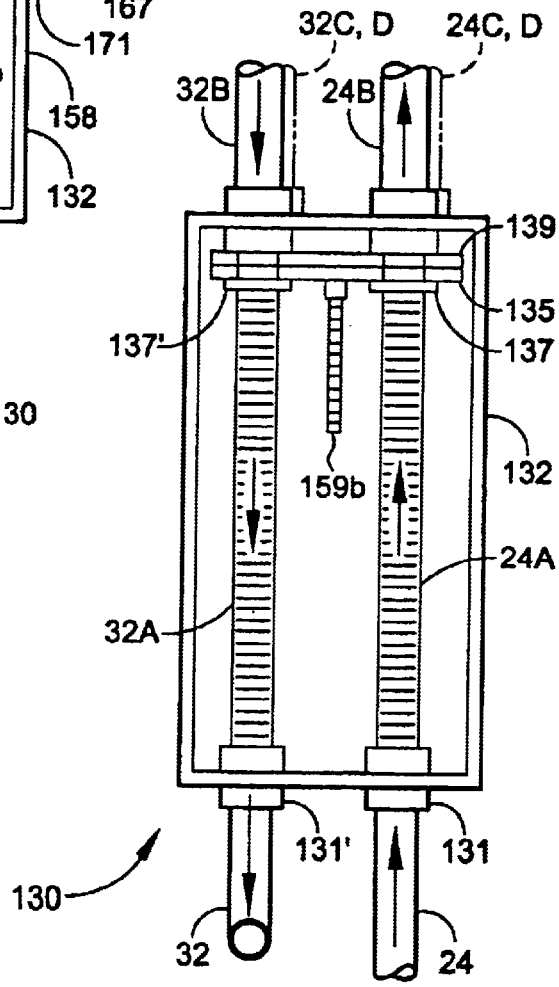
Figure 28A:
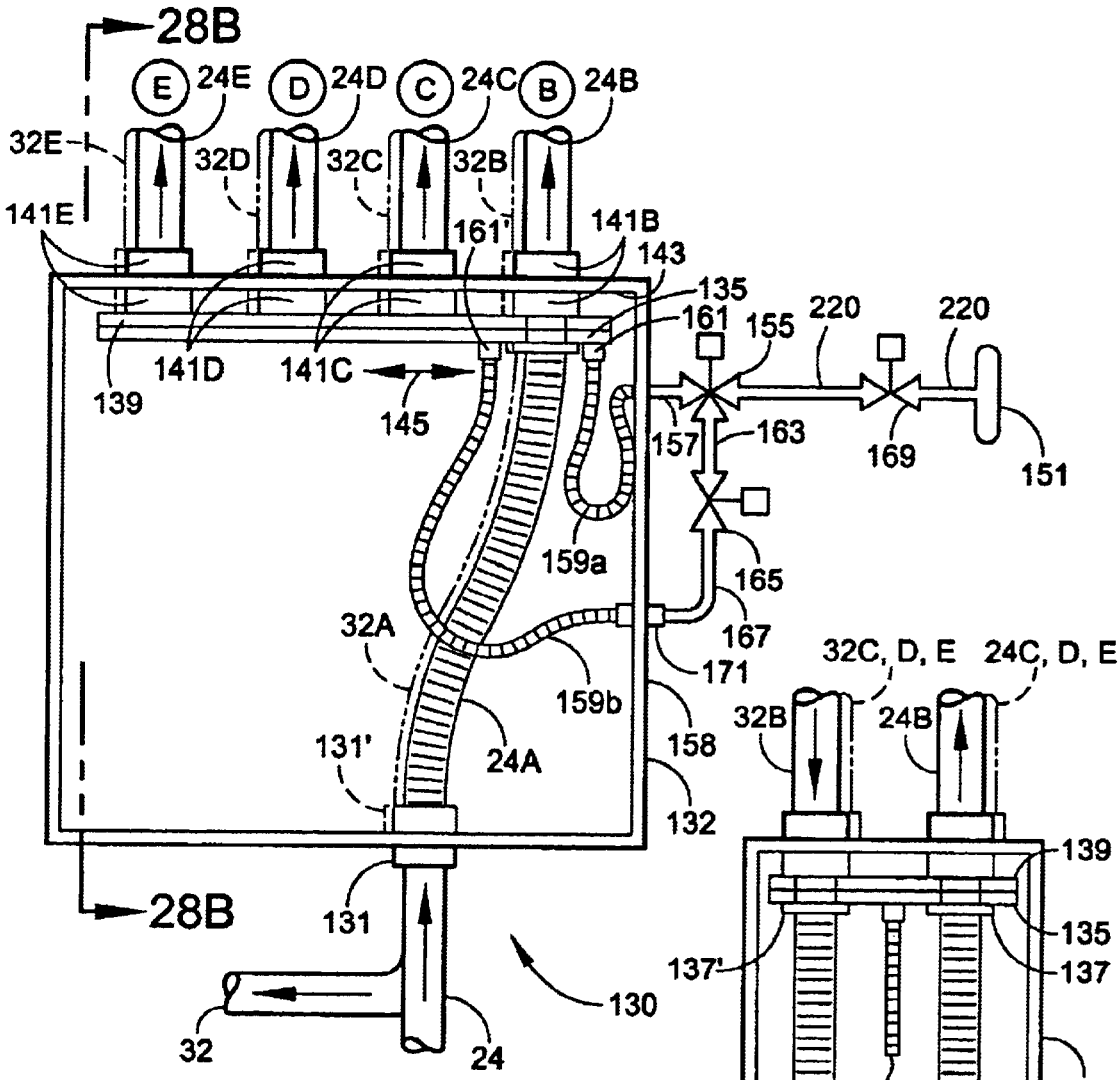
Figure 28B:
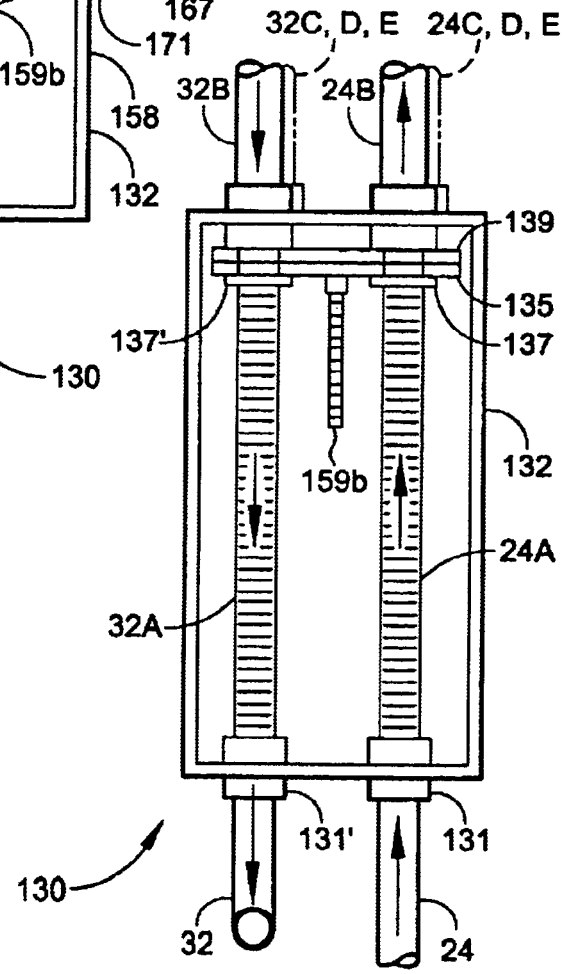

Mechanical, manual or electrical operation of the slider 135 is illustrated in FIGS. 31 and 32. In FIG. 31 the slider 135 has small wheels 191 which run a track 193 and are powered by motors 195 which are connected to wires 197. In FIG. 32 the slider 135 is attached to belt or cord 199 at 201. Belt or cord 199 is looped around idler pulley 203 and drive pulley 205. Drive pulley 205 can be driven by a motor 207 or manually operated by a hand crank 209. Operation of the drive pulley 205 electrically or by hand causes slider 135 for move in the direction determined by the direction of rotation of pulley 205. If desired slider 135 can also have wheels and a track as shown in FIG. 31.

Cleaning of the system is preferable readily done by passage of a liquid cleaning solution through the system. The liquid solution is injected into the system at or ahead of the inlet 18 to conduit 24, and is drawn through the conduit 24 by operation of the vacuum pump 34 in the same manner as for conveying ice. The liquid contacts all of the interior surfaces of the conduit 24. When it reaches separator 46, some of the liquid may be diverted into the vacuum air line 32 and the rest passes on into the receptor 3. The portion in the receptor 3 is used to clean the interior surfaces of that device, following which it is drained from the receptor along with accumulated dirt and detritus. The portion in the vacuum line cleans the inlet segment of the air line 32 from the separator 46, but is trapped at the first trap 73 and can be drained (along with collected dirt and detritus) through plug 77. It will be evident that movement of the liquid cleaner through the system will also clean the interior surfaces of any diverters, diverter/shifters and branch ice conduits and branch receptors which may be present. The system's ability to be cleaned by passage of the liquid cleaner through the ice conduit itself is a significant improvement over prior art systems which require separate water or cleaner lines which always have liquid in them. It is undesirable to have liquid filled lines in the ceiling of a building, because of the danger of leakage or of complete rupture of the line, so that the present system, which does not require such liquid-filled lines, is operational superior to prior art systems.

Alternatively the system or portions of it may be cleaned manually.

It is also advantageous to encase the ice conveying conduits 24, 24B, etc. in thermal insulation 40 and/or to refrigerate them to approximately 25°–38° F. (−4° to +3°

C.), preferably 33°–36° F. (0.5°–2° C.), as indicated by cooling coils 156, both as shown in FIG. 17. Either will insure that melting of the ice is minimal or essentially non-existent and that there will be no significant bacterial growth. Equipment for this purpose is commercially available. Cooling is rarely needed for the vacuum lines 32, 32A, 32B, etc. Also, there is usually no need to chill the flexible ice conduit 24A since its represents only a very short distance of travel for the ice and the presence of cooling coils could hinder the traversing motion of conduit 24A.

Figure 33:
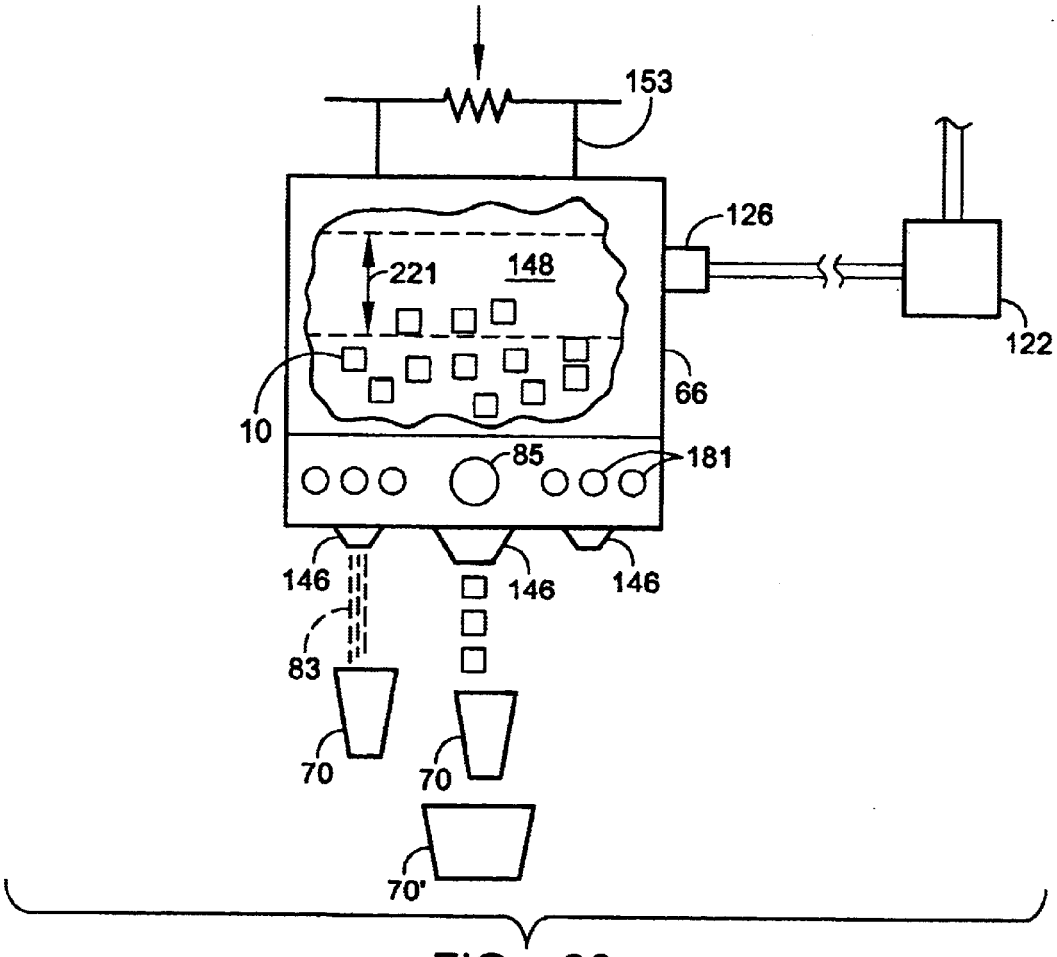
FIG. 33 is a side elevation view and schematic diagram illustrating automatic refilling of ice dispensers as the ice content is depleted by dispensing of ice demanded by users.

FIG. 33 illustrates a manner of providing for automatic filling of receptor such as ice dispensers/IBDs 66. Each IBD 66 has an internal chamber or bin 148 for retention of the ice and from which the ice is dispensed through the dispenser chutes 68 upon patron operation as described above. It is preferred to provide for automatic filling of the dispensers 66 to maintain the ice content in the bin 148 within a predetermined range designed by arrow 221 bridging between two dotted lines indicating the maximum and minimum ice levels desired for the bin 148. To this end the ice bin 148 of each dispenser 66 will be equipped with a sensor 126 which is used to determine some parameter related to the amount of ice in the dispenser. A variety of different parameters may be used; ice weight or volume, temperature within the ice bin 148, use of sonar echoes or a light beam to detect the ice level, strain gauge measurements of the bin sides or bottom, and so forth. It is preferred that the method used be non-mechanical, since mechanical sensor arms or other structures within the ice bin are subject to damage and malfunction by the movement of ice into, within and out of the bin 148. A signal which communicates the measurement of the ice quantity-related parameter is generated by the sensor 126, either continually or intermittently, and conveyed through the electronic signal lines to system controller 122. Controller 122 is programmed to convert such parameter measurements into determination of the quantity of ice in bin 148 of each dispenser 66. The signals generated by the individual sensors 126 on the different dispensers 66 will also be coded or otherwise identifiable by the controller 122 as to which of the dispensers 66 the signal is coming from. When the controller 122 determines from a received signal that the ice quantity in a particular bin 66 is below the desired amount, it generates signals which operate the ice making, transport and conveying equipment. Controller 122 activates the motor 20 of auger 12 and the off/on switch 170 of ice maker 6 to cause the ice machine 6 to form additional ice cubes 10 and dispense them from the ice maker 6 to the auger 12. When the ice cubes are formed it also starts the vacuum pump 34 so that the produced ice cubes 10 will be conveyed to the particular dispenser 66 in which the ice supply has become depleted. Separately, controller 122 may operate the diverter/air shifter 130 (in multi-branch systems) to make the diverter/air shifter 130 route the ice cubes 10 through the appropriate conduit branch 24B, 24C, . . . to the target dispenser 66.

Controlling on the minimum ice level is also contemplated, to insure that the quantity of ice in a dispenser does not fall below a predetermined volume. Such a control system would be of value, for instance, where there are several dispensers which all are heavily used in a short period of time, such as the dispensers at a fast food restaurant at lunchtime. The ice conveyance system, while responding to "less than full" messages from all of the dispensers, would have the capability to override the normal ice replenishment schedule and direct ice to a particular dispenser from which a "minimum level reached" signal is received. This would insure that no dispenser becomes completely depleted of ice while others, which still have substantial ice supplies, are being replenished.

In a single dispenser system, when controller 122 receives a signal from the sensor 126 indicating that the bin 148 of the dispenser 66 has reached its maximum allowable capacity of ice, the controller 122 sends signals to shut off the ice maker 6 and the conveying system to keep the bin 148 from overflowing. In most systems, where there are a number of different dispensers 66 on the system, the system may be run by controller 122 on a wide variety of schedules, utilizing diverters such as 130 to route ice to the different bins 148 on an as-needed basis. Thus some heavily used dispensers can be replenished with ice cubes 10 more frequently than lesser used dispensers, as indicated above. It is also contemplated that, in limited access locations, an IBD or other dispenser may be require a small container 148 which must be refilled by relatively frequent, small volume transfers of ice.

Such small transfers may be accomplished by pulsing of the system. In most operations the system will be run in a continuous or semi-continuous mode, in which ice is being made or otherwise provided by the ice source 1 and being moved into various conduit(s) 24 and on to various receptor (s) 3 over an extended period of time, which may be measured as hours, days or weeks. Such may be the case, for instance, for operation of a bulk ice storage facility. On the other hand, when only small quantities are periodically needed by a receptor, pulsing of the system to that receptor is advantageous. Such purging can, for instance, deliver small quantities of ice to an automatic ice bagger for supply of bagged ice or to an individual hotel room or nurses' station, or can be used to purge the system conduits of ice. Purging is most easily accomplished through use of the controller 122, and involves starting of the vacuum pump and ice unbridge, running of the unbridger for a specified period of time sufficient to deliver the predetermined quantity of ice into the vacuum air stream, then stopping the unbridger while allowing the vacuum flow to continue long enough for the ice to travel the length of the conduit(s) to the receptor. The vacuum source is then turned off, and then, after a few second's delay to allow the accumulator and receptor to clear, the vacuum source and then the unbridger can be restarted if additional pulses are needed or desired. This cycle can be repeated as often as necessary, and at whatever intervals are convenient, until the ice supply is depleted or the ice demand has been satisfied. This operation works well when there are numerous small volume receptors, such as rooms in a hotel, where each individual receptor requires only a small amount of ice at infrequent intervals, but cumulatively there are many such small demands occurring frequently. The system can be pulsed for one receptor, such as a hotel room, and then after cessation of that pulse and the clearance interval, appropriate diverters in the system can be reset and a subsequent pulse used to send another small quantity of ice to a different hotel room, and so forth.

Pulsing is also important for operation with small receptors that are located in tight spaces, where it may not be possible to use an accumulator 30 or where there is only a small accumulator with capacity limited such that accumulated ice weight alone may not be sufficient to insure reliable opening of the accumulator gate 50. By pulsing such a system in the manner described above, a small quantity of ice cubes 10 can be sent directly into the receptor 3. Alternatively, if there is a small accumulator, pulsing allows the gate 50 to open by its own weight when the vacuum is turned off, so that the accumulated ice 10, even if only a small quantity, can fall by gravity into the receptor 3.

It will be evident that these operations can be conducted automatically, so that ice is essentially always adequately available without intervention or action by establishment employees. Ice bins 148 can thus be refilled to maximum levels automatically during periods of low usage (such as at night) whether or not establishment employees are present. To this end sensor 126 will normally also serve as an ice detector, to provide a signal when no ice is present in bin 148. This will be able to alert establishment employees that ice dispensing has been a such a high rate than the automatic refilling system has been unable to keep up with the ice demand, or, conversely, that the automatic refilling system has failed or malfunctioned, and will have to be restarted or ice will have to be provided by alternative means, such as by hand, or by connection into the system of a secondary or back-up ice source such as ice source 25 in FIGS. 2 and 3.

The system can include many conventional commercial parts, such as the ice making equipment, auger, pneumatic conveying conduit and diverter. Also, the units 66 may be conventional beverage and ice dispensers which are simply adapted to receive the conveyed ice into their internal collection bins 148 from the accumulators 30. The sensors 126 are desirable and preferred, but it would be also possible for an operator (such as a restaurant employee), to periodically monitor the bins 66 to visually observe the quantity of ice and then control the system manually by the operation of controller 122 through keyboard or panel 172. Of course, the automatic operation with the sensors 126 and the controller 122 is to be preferred, since the system then does not need the visual observation and control of any person and thus avoids problems of overfilling or emptying of the ice bins if the assigned employee is unobservant or becomes preoccupied with other duties. However, it is also desirable to provide for manual monitoring and operation, for convenient access to the various components of the system when the system is off-line, such as for maintenance.

The conduit 24 and vacuum line 32 may be of any convenient length along which the ice can be conveyed without significant damage to or melting of the cubes 10. A typical length will be in the range of approximately 100–300 ft (30–90 m) from the outlet 18 to the farthest receptor 3, although longer conduit lengths are both contemplated and possible. Normal size conveying conduits 24 may be used, which will generally have inside diameters in the range of 2–6 in (5–15 cm).

The system may be constructed of any convenient materials which commonly are used to contain ice and which are approved for contact with foods. Such materials include stainless steels and similar metals as well as some food grade plastics. As noted above, the ice cubes or pieces 10 may be of any size and shape which can be conveyed at a reasonable speed and without undue melting or damage through the conduit 24. In most cases, the ice cubes or pieces 10 will be solid bodies of generally equal or similar length, width and depth dimensions with the largest dimension(s) being in the range of about 1"–6" (25–150 mm). The volume and weight of each cube will be directly related, since ice has a substantially constant density of 1.0. The maximum and minimum sizes and shape proportions of ice that can be conveyed within a given system by a particular level of vacuum and volume of airstream flow can be readily determined by those skilled in the art without any undue experimentation.

In addition to ice conveyance uses in the restaurant, hotel/motel and hospital industries, it will be recognized that there will be many applications of ice conveyance in convenience stores, food processing plants, cold storage facilities, scientific research laboratories and many other establishments. It is therefore to be understood that the present system is not to be considered to be specific solely to any one particular industry or type of facility or establishment, but may be conveniently used anywhere where ice conveyance and/or maintenance of quantities of such items at remote locations from a source is either convenient or necessary.

It will be recognized that there are numerous embodiments of the present invention which, while not expressly described above, are clearly within the scope and spirit of the invention. The above description is therefore intended to be exemplary only, and the scope of the invention is to be limited solely by the appended claims.

We claim:

1. Apparatus for conveying ice comprising:

a plurality of receptors for receiving ice, with at least one receptor at each of a plurality of remote locations;

wherein said ice is substantially uncontaminated ice cubes;

a hollow elongated ice conduit having an initial conduit portion from a source of ice to at least one intermediate division point from which a plurality of branch conduits extend, said initial conduit and said branch conduits providing an ice communication connection between said source of ice and said plurality of receptors;

a diverter in said conduit at each said intermediate division point for direction of ice traversing said conduit from said initial conduit to any of said branch conduits; and a vacuum pump in fluid communication through a vacuum line having an inlet approximate to each said receptor for withdrawing air from said conduits and creating a vacuum comprising said negative air pressure in said conduits, said negative air pressure causing said ice to traverse said conduit from said source through said diverter to a selected one of said plurality of receptors.

2. Apparatus as in claim 1 wherein each said diverter further comprises a shifter for aligning said diverter with any selected one of said plurality of branch conduits at said intermediate division point.

3. Apparatus as in claim 1 wherein said plurality of conduits is in a range from two to four.

4. Apparatus as in claim 1 further comprising said vacuum line also having at least one coincident intermediate division point from which an equal plurality of branch vacuum lines extend, each such branch vacuum line forming a pair with a corresponding branch ice conduit and extending to and connecting with a corresponding one of said plurality of receptors, and each said diverter at each said intermediate division point also simultaneously directing said vacuum into and through that branch vacuum line paired with any selected one of said plurality of branch ice conduits.

5. Apparatus as in claim 4 wherein said diverter further comprises a shifter for routing ice conveyance and direction of vacuum to alternate pairs of corresponding branch ice conveyance conduits and branch vacuum lines.

6. Apparatus as in claim 1 wherein said at least one of said receptors therein comprises an accumulator with an inlet and an outlet and has an openable gate for release therefrom at said remote location of accumulated pieces of ice conveyed thereto from said source.

7. Apparatus as in claim 6 further comprising said gate being hingedly affixed to said accumulator and biasing means for biasing said openable gate into close contact with said accumulator and closing said outlet.

8. Apparatus as in claim 7 wherein said outlet of said accumulator is defined by an end of a peripheral wall of said accumulator surrounding said outlet, said end of said wall comprising an interior side of said wall and an exterior side of said wall joined by a width of said wall, said edge of said outlet comprising a junction line of said width and said interior side, said configuration comprises a chamfer across at least a portion of said width and terminating at an apex of an acute angle at said edge.

9. Apparatus as in claim 1 further wherein said vacuum line connects in fluid communication into said branch conduit at a first point of connection upstream of a second point of connection of said branch conduit into a respective receptor, and wherein said vacuum line is spaced apart from said second point of connection by an interval not greater than a distance that said ice pieces can traverse under momentum imparted to them by their prior conveyance by said negative air pressure, such that diversion of at least a portion of conveying force of said negative air pressure at said point of connection does not prevent said ice pieces from continuing to traverse entirely through said initial branch conduits and into said receptor.

10. Apparatus as in claim 9 further comprising said first point of connection of said hollow conduit and said vacuum line being located in an expanded internal breadth portion of said hollow conduit, such that in said expanded internal breadth portion, said velocity of air moving under said negative air pressure is diminished relative to said velocity of said air in an immediately upstream portion of said hollow conduit.

11. Apparatus as in claim 9 further comprising said vacuum line and said hollow conduit at said first point of connection being connected at an angle that precludes diversion of said ice pieces from said hollow conduit into said vacuum line.

12. Apparatus as in claim 9 further comprising said vacuum line at said first point of connection line with said hollow conduit wherein said vacuum line has a maximum inside width less than minimum breadth of any of said ice pieces, such that diversion of said ice pieces from said hollow conduit into said vacuum line is precluded.

13. Apparatus as in claim 1 further wherein said receptor is disposed adjacent to an inlet of a subsequent conduit leading to a subsequent accumulator at another remote location, and said pieces of ice released from said receptor are deposited into said inlet for conveyance through said subsequent conduit to said subsequent accumulator at said another remote location.

14. Apparatus as in claim 13 further comprising another vacuum line in fluid communication with said subsequent conduit for moving said ice through said subsequent conduit to said subsequent accumulator at said second remote location.

15. Apparatus as in claim 1 further comprising a collector into which ice pieces delivered from said source of ice are received, said collector having a first opening into said first conduit, and further comprising unbridging means associated with said collector for presenting said released ice pieces individually and unbridged to said first opening, whereby said ice pieces pass through said first opening into said first conduit.

16. Apparatus as in claim 15 wherein said unbridging means also motivates said ice pieces through said opening into said first conduit.

17. Apparatus as in claim 1 further comprising sensor means for detecting the presence or absence of ice in said receptor.

18. Apparatus as in claim 17 wherein said sensor means periodically measures a parameter value which is dependent upon said quantity of ice and from which said quantity of said ice can be determined.

19. Apparatus as in claim 1 wherein at least one of said branch conduits has a further intermediate division point with a further diverter from which a further plurality of branch conduits extend, each further branch conduit leading directly to a further plurality of receptors and providing an ice communication connection between said source of ice and by means of said further diverter to each receptor in said further plurality of receptors.

20. Apparatus as in claim 1 further comprising cleaner introducing means for introducing a liquid cleaner into said ice conduit and conveying said liquid cleaner through said ice conduit under said negative air pressure, whereby passage of said cleaner through said ice conduit cleans contaminants from the interior of said conduit, and upon discharge of said cleaner at an outlet of said conduit, said cleaner removes from said conduit said contaminants entrained in said cleaner.

21. Apparatus as in claim 1 wherein at least one receptor at a remote location comprises an air lock device which is connected to said ice conduit on an upstream side and which has an inlet for pressurized air from a source thereof on a downstream side and another conduit extending from said downstream side for passage of said pressurized air, such that ice entering said air lock device from said ice conduit passes through said air lock device and is propelled through said another conduit at high velocity by said pressurized air.

22. Apparatus as in claim 21 wherein that portion of said another conduit downstream of said airlock comprises flexible tubing with an outlet at an end distal from said air lock device and further comprising directing means for moving said outlet of said flexible tubing such that ice passing through said flexible tubing at high velocity can be projected from said outlet in various directions and to various distances.

23. Apparatus as in claim 1 wherein that portion of said another conduit downstream of said air lock comprises flexible tubing with an outlet at an end distal from said air lock device and further comprising directing means for manual, mechanical, pneumatic or electrical positioning of said outlet of said flexible tubing.

24. Apparatus as in claim 1 wherein said source of ice comprises a plurality of individual sources of ice and said initial conduit is connected through an initial diverter to a plurality of source conduits each having one of said individual sources of ice at the end distal from said initial diverter, with vacuum being drawn in each source conduit by said vacuum pump, such that said ice can be directed from any of said individual ice sources into said initial conduit for conveyance to said receptors.

25. Apparatus as in claim 1 wherein said receptor comprises an ice dispensing device.

26. Apparatus as in claim 25 further comprising said ice dispensing device having dispensing means for dispensing individual quantities of said pieces of ice to an operator of said dispensing device upon demand of said operator.

27. Apparatus as in claim 26 further comprising said ice dispensing device also comprising means for dispensing individual quantities of liquid beverages to said operator of said dispensing device upon demand of said operator.

28. A process for conveying ice comprising:

a. disposing a plurality of receptors for receiving ice at a plurality of remote locations, with at least one receptor of said plurality disposed at each of said remote locations;

b. wherein said ice is substantially uncontaminated ice cubes;

c. providing a hollow elongated ice conduit having an initial conduit portion from a source of ice to an intermediate division point from which a plurality of branch conduits extend, and directing transport of said ice through said initial conduit and said branch conduits between said source of ice and said plurality of receptors;

d. disposing a diverter in said conduit at said intermediate diversion point and controlling said diverter to direct ice traversing said conduit from said initial conduit to any one of said branch conduits; and e. providing a vacuum pump in fluid communication through a vacuum line having an inlet proximate to each said receptor for withdrawing air from said conduits and creating a vacuum comprising said negative air pressure in said conduits, said negative air pressure providing means for transport of said ice through said conduit from said source through said diverter to a selected one of said plurality of receptors.

29. A process as in claim 28 further comprising forming at least one serial connection between two sequentially aligned conduits through a diverter and disposing one of said two sequentially aligned conduits as one of a plurality of conduits which can be alternately connected to the other of said two sequentially aligned conduits through said diverter.

30. A process as in claim 28 comprising conveying said ice and vacuum through a plurality of paired, serially connected conduits to reach said receptor.

31. A process as in claim 30 comprising forming at least one serial connection between two sequentially aligned paired ice and vacuum conduits through a diverter.

32. A process as in claim 31 further comprising disposing one of said two sequentially aligned paired ice and vacuum conduits as one of a plurality of paired ice and vacuum conduits which can be alternately connected to the other of said two sequentially aligned paired ice and vacuum conduits through said diverter.

33. A process as in claim 28 further comprising providing in at least one said receptor an openable gate causing pieces of ice conveyed into said receptor through said conduit by said vacuum to come to rest bearing upon said gate, said accumulator at said remote location; said gate being biased against opening; and thereafter releasing of accumulated pieces of ice conveyed from said source from said receptor at said remote location by counteracting or eliminating of said gate.

34. A process as in claim 28 wherein said receptor comprises an air lock device and said process further comprises providing for said air lock device an air communication connection to a source of pressurized air on a downstream side thereof and ice and air communication with another conduit extending from said downstream side and having an outlet end distal to said air lock device, for passage of said pressurized air, and causing ice to enter said air lock device from said ice conduit and pass therethrough to encounter pressurized air moving at high velocity on said downstream side and become entrained in said pressurized air moving at high velocity and be propelled through said another conduit and thereby be dispersed at high speed from said outlet end of said another conduit.

35. A process as in claim 28 further comprising:

a. connecting said vacuum line in fluid communication into each said branch conduit at a first point of connection upstream of a second point of connection of said ice conduit into said receptor, and spaced apart from said second point of connection by an interval not greater than a distance that said ice pieces can traverse under momentum imparted to them by their prior conveyance through said conduit by said negative air pressure; and b. conveying said ice pieces under that amount of force of said negative air pressure at said first point of connection sufficient to cause said ice pieces to continue to traverse entirely through said initial conduit, said diverter and said branch conduit and into said receptor without diversion of any ice pieces into said first vacuum line.

36. A process as in claim 35 further comprising causing velocity of air at said first point of connection and moving under said negative air pressure to be diminished relative to velocity of said air in an immediately upstream portion of said ice conduit by disposing said first point of connection in an expanded internal breadth portion of said first hollow conduit.

37. A process as in claim 36 further comprising forming said expanded internal breadth portion of said hollow conduit with a length sufficiently great that one portion of any liquid being conveyed through said conduit will be diverted into said first vacuum line and another portion of said liquid will continue to traverse through said ice conduit and into said receptor.

38. A process as in claim 28 further comprising disposing in at least one receptor a sensor for detection of presence of ice in said ice dispenser, and generating a signal from said sensor when a quantity of ice in said receptor falls below a predetermined minimum, said signal being responded to by operation of said vacuum pump to draw ice from said source and transport said ice through said conduit to said receptor to replenish the quantity of ice to an amount greater than the predetermined minimum.

39. A process as in claim 28 wherein ice pieces delivered from said source of ice to said initial conduit are received at said receptor in at least partially bridged condition, and further comprising unbridging said ice pieces prior to delivering said ice pieces into said initial ice conduit.

40. A process as in claim 28 wherein said receptor comprises an ice dispensing device, an accumulator or an air lock device.

* * * * *